US007573446B2

(12) United States Patent
Kawaguchi et al.

(10) Patent No.: US 7,573,446 B2
(45) Date of Patent: Aug. 11, 2009

(54) METHOD AND DEVICE FOR DRIVING LED ELEMENT, ILLUMINATION APPARATUS, AND DISPLAY APPARATUS

(75) Inventors: Yoshinobu Kawaguchi, Tenri (JP); Shigetoshi Ito, Shijonawate (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 629 days.

(21) Appl. No.: 11/043,938

(22) Filed: Jan. 28, 2005

(65) Prior Publication Data

US 2005/0168564 A1 Aug. 4, 2005

(30) Foreign Application Priority Data

Jan. 30, 2004 (JP) ..... 2004-022940

(51) Int. Cl.
*G09G 3/32* (2006.01)

(52) U.S. Cl. ..... 345/83; 345/82; 345/204; 345/609; 345/691

(58) Field of Classification Search ..... 345/83, 345/82, 204, 609–691
See application file for complete search history.

(56) References Cited

U.S. PATENT DOCUMENTS 4,666,793 A * 5/1987 Hirate ..... 428/690
6,628,249 B1 * 9/2003 Kamikawa et al. ..... 345/44

FOREIGN PATENT DOCUMENTS

| | | | |
|---|---|---|---|
| JP | 06-268332 | | 9/1994 |
| JP | 11-121806 | A | 4/1999 |
| JP | 2001-144332 | A | 5/2001 |
| JP | 2001/272938 | | 10/2001 |
| JP | 2002-237619 | A | 8/2002 |
| JP | 2002-261334 | * | 9/2002 |
| JP | 2002/261334 | | 9/2002 |
| JP | 2002/324685 | | 11/2002 |

OTHER PUBLICATIONS

Partial English Language Translation of JP 06-268332.

* cited by examiner

*Primary Examiner*—Richard Hjerpe
*Assistant Examiner*—Leonid Shapiro
(74) *Attorney, Agent, or Firm*—Harness, Dickey & Pierce, P.L.C.

(57) ABSTRACT

A driving method and a driving device are provided for an LED element in which light emitting layers different from each other in light emission wavelength peak, put on each other with a barrier layer being interposed, are sandwiched by a pair of p-type and n-type layers, and color of emitted light from which substantially depends only upon driving current value. The method comprises a driving current value calculation step of obtaining a value for designating a current value corresponding to a desired color of emitted light from the LED element; a driving current generation step of generating a driving current having the current value designated by the value obtained in the driving current value calculation step; and a driving current supply step of supplying the LED element with the driving current generated in the driving current generation step.

11 Claims, 15 Drawing Sheets

METHOD AND DEVICE FOR DRIVING LED ELEMENT, ILLUMINATION APPARATUS, AND DISPLAY APPARATUS

BACKGROUND OF THE INVENTION

1. Field of the Invention

The present invention relates to a driving method and a driving device for driving an LED element having therein a plurality of light emitting layers different from each other in light emission wavelength peak, and also to an illumination apparatus and a display apparatus.

2. Description of the Related Art

As techniques on III-V compound semiconductors and organic compound semiconductors progress, illumination apparatus have been proposed that use light emitting diodes (LEDs) made of those materials. However, because ordinary LED elements are high in purity of color of emitted light, it is difficult to obtain a color low in chroma, suitable for an illumination apparatus, such as white, only by an LED element having therein a layer or layers for emitting light of a single color. For this reason, an illumination apparatus has been devised that uses LED lamps in each of which three kinds of LED elements for red (R), green (G), and blue (B) are provided within one package and the three colors are mixed to emit white light as in general illumination. Another illumination apparatus has been also devised that uses LED lamps in each of which there are molded an LED element for emitting a short-wavelength light such as blue or ultraviolet light, and a fluorescent substance to be excited by the short-wavelength light to emit white light.

In case of the former illumination apparatus, however, because the LED element for emitting red light is made of a GaAs-base compound material, its As ingredient causes heavy environmental load. In addition, in case of the former illumination apparatus, each LED lamp includes therein three kinds of LED elements that differ from one another in base material and thus differ from one another in the manner of change in characteristic in response to a change in the surrounding environment, such as temperature, or due to aging. As a result, the LED lamp is apt to vary in color tone. On the other hand, the latter illumination apparatus is inferior in the point of light emission efficiency because it utilizes wavelength shift by a fluorescent substance. In addition, it is apt to vary in color tone because the change in characteristic of the LED element and the change in characteristic of the fluorescent substance in response to the surrounding environment or due to aging do not match each other.

In order to eliminate those disadvantages, development of an LED element capable of emitting white light by a single chip, as disclosed in JP-A-11-121806, is being advanced. FIG. 15 shows a schematic view of the LED element disclosed in JP-A-11-121806. In the LED element, as shown in FIG. 15, three light emitting layers 103, 105, and 106, made of indium gallium nitride (InGaN), are put on each other with being separated by barrier layers 104. The light emitting layers 103, 105, and 106 differ from one another in light emission wavelength peak, and emit lights in the red, green, and blue regions, respectively. The above-described five layers are sandwiched by an n-type current injection layer 102 formed on a substrate 101, and a p-type current injection layer 107. Electrodes 108 and 109 are formed on the p-type and n-type current injection layers 107 and 102, respectively.

In the LED element, when a current is made to flow between the electrodes 108 and 109, three colors of red (R), green (G), and blue (B) are mixed to emit white light. Further, because each of the light emitting layers 103, 105, and 106 is made of InGaN, various color tones can be realized by controlling the light emission wavelength peak of each light emitting layer within the range from the ultraviolet region to the red region. If LED lamps each including the LED element disclosed in JP-A-11-121806 are used for an illumination apparatus, the above-described disadvantages will be eliminated. In addition, a merit will be obtained that each LED lamp has a simple structure including only one LED element and no fluorescent substance.

Characteristics of the LED element disclosed in JP-A-11-121806 have not yet been sufficiently studied. Thus, even if the LED element is intended to be used for an illumination apparatus or a display apparatus, no technique for effectively driving the LED element has been known.

SUMMARY OF THE INVENTION

An object of the present invention is to provide a driving method and a driving device for effectively driving an LED element including therein a plurality of light emitting layers different from each other in light emission wavelength peak.

Another object of the present invention is to provide an illumination apparatus and a display apparatus in which an LED element including therein a plurality of light emitting layers different from each other in light emission wavelength peak is effectively driven.

By the inventors of the present invention examining the dependence of color of emitted light upon driving current value, of the LED element disclosed in JP-A-11-121806, it was found that the color of emitted light changes as the current value increases, for example, the color tone of emitted light changes from white inclining to pink, to white inclining to blue, as the current value is increased from 1 mA to 200 mA. Further, it was also found that the color of emitted light substantially depends only upon the current value, in other words, the color of emitted light from the LED element in case of being driven by a pulse current is substantially irrespective of the duty of the pulse current if the pulse height of the pulse current, i.e., the pulse current value, is constant.

The present invention has been made on the basis of the above knowledge. According to an aspect of the present invention, a driving method of an LED element in which a plurality of light emitting layers different from each other in light emission wavelength peak, put on each other with a barrier layer being interposed, are sandwiched by a pair of p-type and n-type layers, and color of emitted light from which substantially depends only upon driving current value, comprises a driving current value calculation step of obtaining a value for designating a current value corresponding to a desired color of emitted light from the LED element; a driving current generation step of generating a driving current having the current value designated by the value obtained in the driving current value calculation step; and a driving current supply step of supplying the LED element with the driving current generated in the driving current generation step.

According to another aspect of the present invention, a driving device for an LED element in which a plurality of light emitting layers different from each other in light emission wavelength peak, put on each other with a barrier layer being interposed, are sandwiched by a pair of p-type and n-type layers, and color of emitted light from which substantially depends only upon driving current value, comprises a driving current value calculator that obtains a value for designating a current value corresponding to a desired color of emitted light from the LED element; and a driving current generator that generates a driving current having the current value designated by the value obtained by the driving current value calculator.

According to still another aspect of the present invention, an illumination apparatus comprises an LED element in which a plurality of light emitting layers different from each other in light emission wavelength peak, put on each other with a barrier layer being interposed, are sandwiched by a pair of p-type and n-type layers, and color of emitted light from which substantially depends only upon driving current value; and the above-described driving device for the LED element.

According to still another aspect of the present invention, a display apparatus comprises an LED element in which a plurality of light emitting layers different from each other in light emission wavelength peak, put on each other with a barrier layer being interposed, are sandwiched by a pair of p-type and n-type layers, and color of emitted light from which substantially depends only upon driving current value; and the above-described driving device for the LED element.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Embodiment 1

Hereinafter, Embodiment 1 of the present invention will be described with reference to drawings.

(Outline of Illumination Apparatus)

Figure 1:
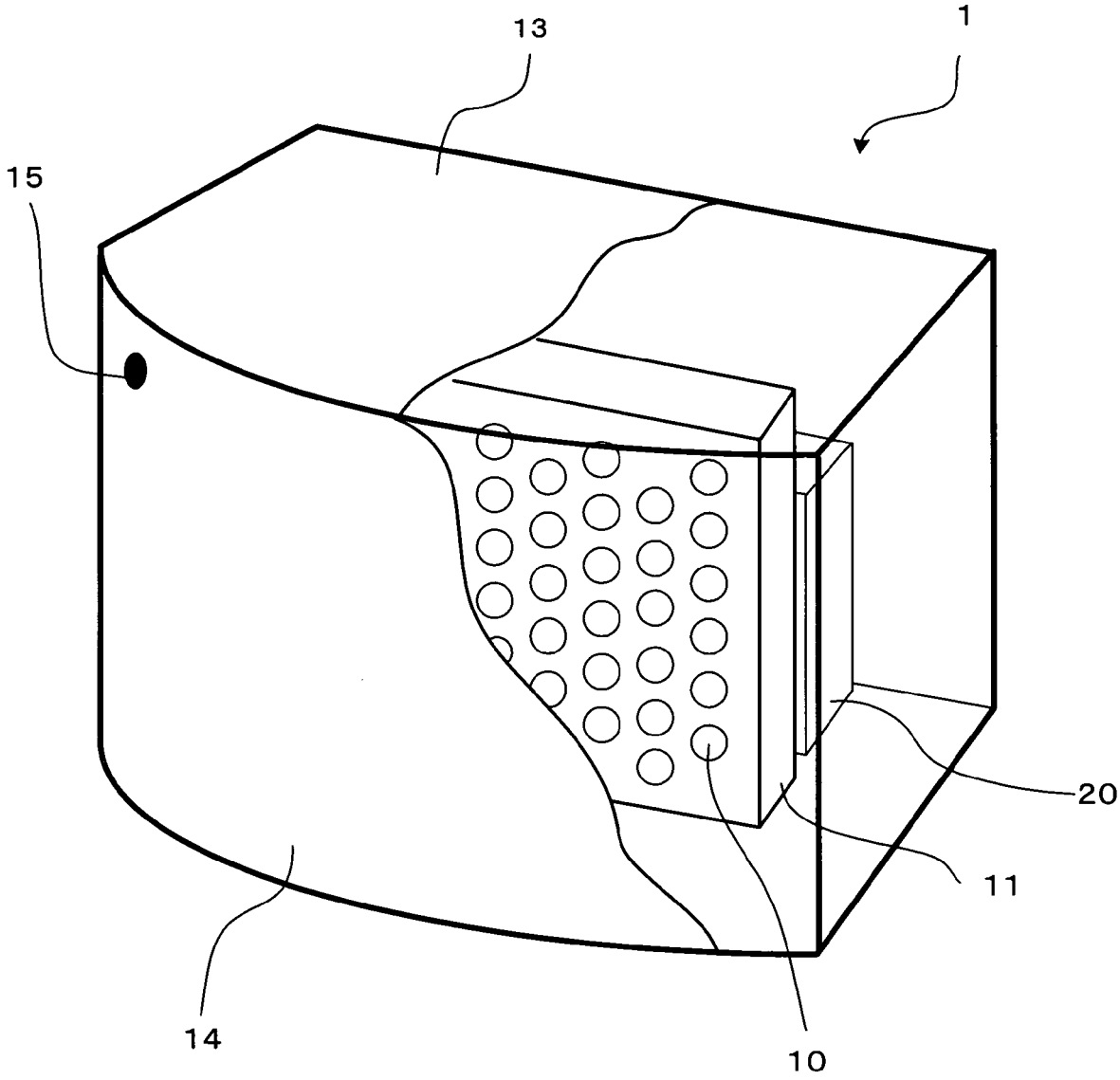
FIG. 1 is an external view of an illumination apparatus according to Embodiment 1 of the present invention.
Figure 2:
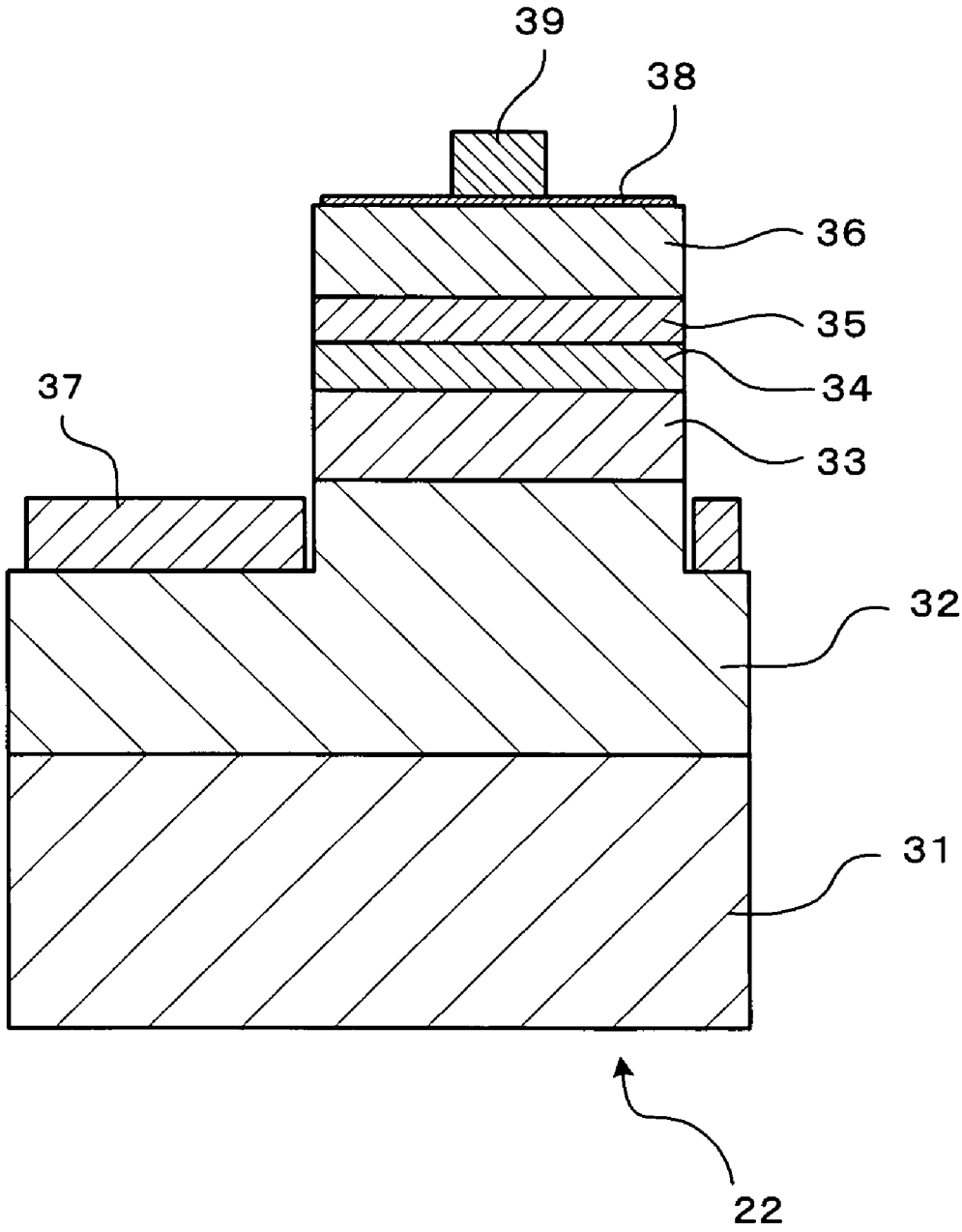
FIG. 2 is a sectional view of an LED element included in the illumination apparatus of FIG. 1.
Figure 3:
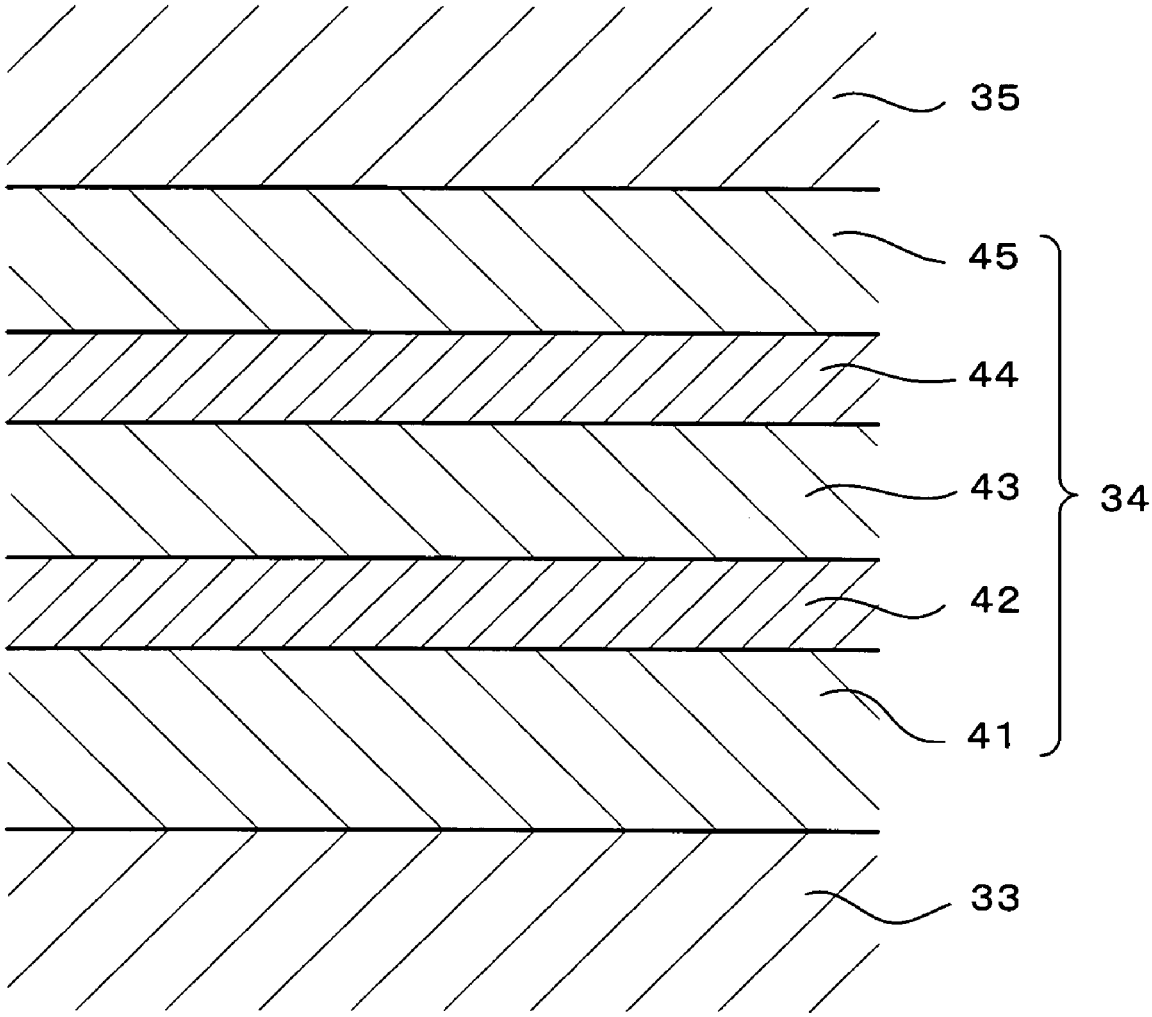
FIG. 3 is an enlarged sectional view of an active region included in the LED element of FIG. 2.

FIG. 1 shows an external view of an illumination apparatus according to Embodiment 1 of the present invention. The illumination apparatus 1 of FIG. 1 includes therein a large number of LED lamps 10, for example, about sixty LED lamps 10. The LED lamps 10 are arranged in a matrix in a plane to form a panel 11. Each LED lamp 10 includes therein one LED element 22 as shown in FIG. 2. As will be described later, the LED element 22 includes therein two light emitting layers 42 and 44, as shown in FIG. 3, made of nitride-base semiconductor, different from each other in light emission wavelength peak. An LED lighting circuit 20 as a driving device for driving the LED lamps 10 is disposed in the rear of the panel 11. The panel 11 and the LED lighting circuit 20 are accommodated in an outer casing 13. A diffuser 14 is attached to the front face of the outer casing 13. The diffuser 14 is for diffusing output lights from the LED lamps 10 to uniformly emit the lights. A receiver 15 is provided on the front face of the outer casing 13. The receiver 15 is for receiving instruction signals for ON/OFF of the illumination apparatus 1, designating the color of emitted light, designating the brightness, and so on, from a remote controller provided separately from the outer casing 13.

(Construction of LED Element)

FIG. 2 shows a sectional view of an LED element 22 included in the illumination apparatus 1 according to this embodiment. The LED element 22 includes a sapphire substrate 31, on which a not-shown GaN buffer layer, an n-type GaN contact layer 32, an n-type InGaN clad layer 33, an active region 34, a p-type $Al_{0.1}Ga_{0.9}N$ vaporization prevent layer 35, and a p-type GaN contact layer 36 are put in this order. A p-type electrode 38 made of a palladium (Pd) film is formed into a pattern substantially on the whole of the upper face of the GaN contact layer 36. An electrode pad 39 made of molybdenum/gold (Mo/Au) is formed into a pattern on the p-type electrode 38. The GaN contact layer 32 has a convex shape in which a protrusion is formed on the middle of the upper face of the GaN contact layer 32. The above-described layers 33 to 36 are formed only on the protrusion. An n-type electrode 37 made of a hafnium (Hf) film and an aluminum (Al) film formed on the hafnium film is formed into a pattern on the portion of the upper face of the GaN contact layer 32 other than the protrusion.

FIG. 3 shows an enlarged sectional view of the active region 34. As shown in FIG. 3, the active region 34 is made up of an InGaN barrier layer 41, an InGaN blue light emitting layer 42, an InGaN barrier layer 43, an InGaN yellow light emitting layer 44, and an InGaN barrier layer 45, which are put on each other in this order from the sapphire substrate 31 side. That is, the active region 34 has a two-layer multi quantum well (MQW) structure in which two light emitting layers 42 and 44 different from each other in light emission wavelength peak are disposed in series. The thickness of each of the barrier layers 41, 43, and 45 is about 2 to 10 nm. The thickness of each of the light emitting layers 42 and 44 as the well layer is about 1 to 6 nm. The thickness and composition of each of the light emitting layers 42 and 44 have been controlled so as to be optimum in accordance with the color of the emitted light from each layer.

To manufacture the LED element 22, first, the sapphire substrate 31 is laminated with the GaN buffer layer and then the above-described layers 32 to 36 are formed thereon. Afterward, dry etching by reactive ion beam etching (RIBE) is carried out from the GaN contact layer 36 side to expose the GaN contact layer 32. The n-type electrode 37 is then formed into a pattern on the exposed face of the GaN contact layer 32. The p-type electrode 38 is formed into a pattern on the GaN contact layer 36 and then the electrode pad 39 is formed into a pattern on the p-type electrode 38.

In the LED element 22 having the above construction, the area of the portion for emitting light is substantially determined by the plane area of the p-type electrode 38. In this embodiment, the plane area of the p-type electrode 38 is 0.04 $mm^2$. However, the plane area can be adequately changed within the range from about 0.001 to 11 $mm^2$. The active region 34 is not limited to the above-described two-layer multi quantum well structure. The active region 34 may have a multi quantum well structure of about 3 to 10 layers. Even in such a case, the number of wells to each light emitting layer is desirably held down to about 1 to 4 in order to suppress unevenness of current injection to the light emitting layers due to an increase in the number of wells to each light emitting layer.

The composition of each layer of the LED element 22 is not limited to the above-described composition and can be adequately changed. For example, as the material of the substrate 31, in place of sapphire, GaN, SiC, Si, GaAs, etc., can be used. As the material of the n-type contact layer 32, in place of GaN, AlGaN, AlInGaN, and further a super lattice structure of GaN and AlGaN, can be used. As the material of the n-type clad layer 33, in place of InGaN, GaN, AlGaN, AlInGaN, and further a super lattice structure of InGaN and GaN, can be used. As the material of the vaporization prevent layer 35, in place of $Al_{0.1}Ga_{0.9}N$, AlInGaN, and further a super lattice structure of AlInGaN and AlGaN, GaN, or InGaN, and a super lattice structure of AlGaN and GaN or InGaN, can be used. For the light emitting layers and the barrier layers in the active region 34, any of GaN, AlGaN, InGaAlN, GaNP, InGaNP, AlGaNP, GaNAs, InGaNAs, and AlGaNAs can be adequately used.

Further, in the active region 34, the positions of the InGaN blue light emitting layer 42 and the InGaN yellow light emitting layer 44 may be exchanged. Also in case of using three or more light emitting layers, the positions of the light emitting layers can be arbitrarily exchanged.

(Characteristics of LED Element)

Figure 4:
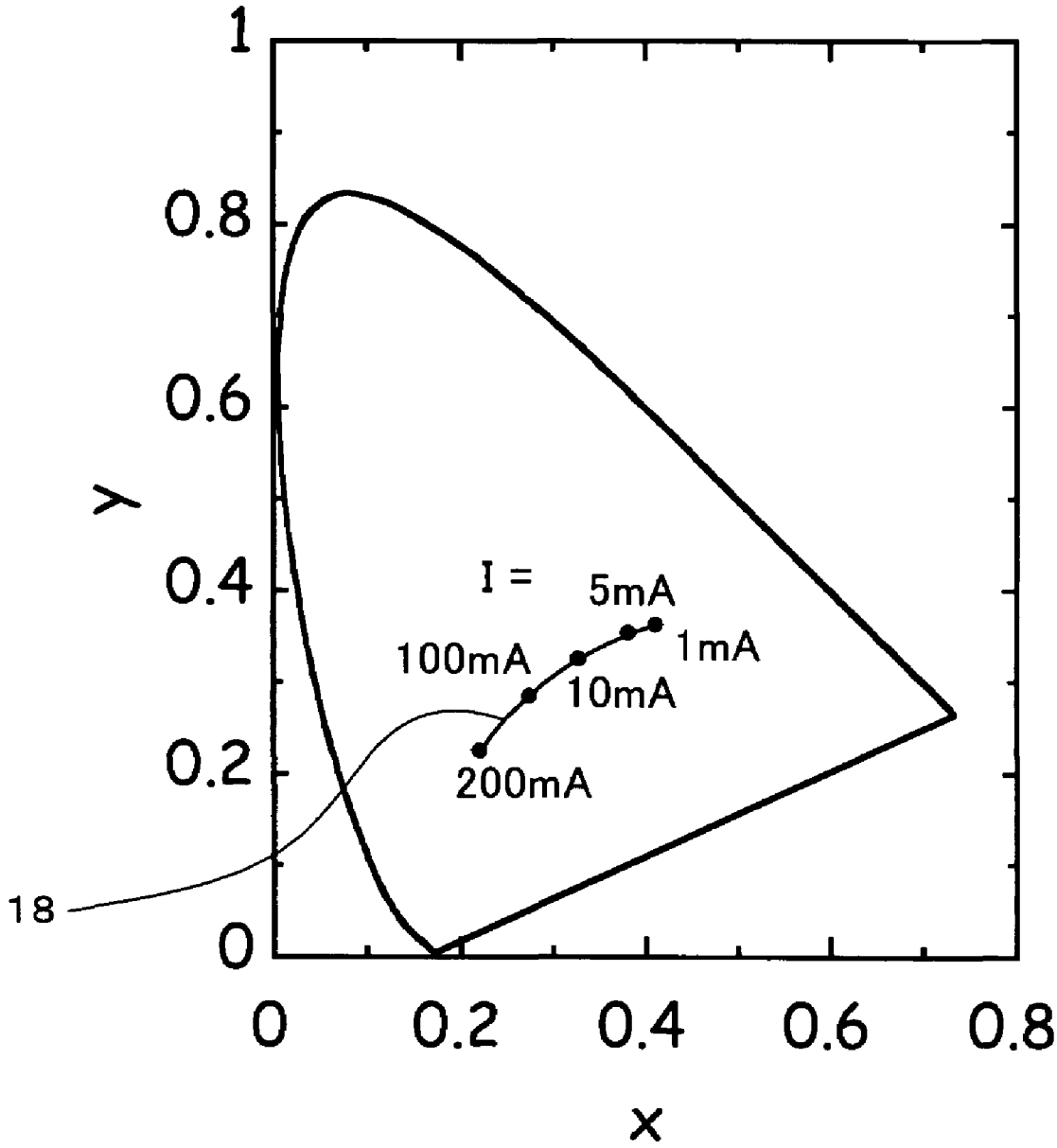
FIG. 4 is a CIE standard chromaticity diagram showing a color of emitted light versus driving current value characteristics of the LED element of FIG. 2.

FIG. 4 is a CIE standard chromaticity diagram showing a relation between driving current value and color of emitted light when the LED element 22 is driven by a constant direct current, that is, a color of emitted light versus driving current value characteristics. A line 18 in FIG. 4 represents a locus showing a change in color of emitted light as the driving current value is changed from 1 mA to 200 mA. For example, when the driving current is 5 mA, the color of emitted light is white inclining to yellow, (x, y)=(0.38, 0.35). As the current increases, the influence of blue light emission becomes intensive. When the driving current is 100 mA, the color of emitted light becomes white inclining to blue, (x, y)=(0.26, 0.28). When the driving current is 200 mA, the color of emitted light becomes white more inclining to blue, (x, y)=(0.22, 0.22). For example, to obtain white of (x, y)=(0.33, 0.32) by the LED element 22, the driving current to be supplied to the LED element 22 must be about 10 mA. Thus, as the current value increases, the color of emitted light from the LED element 22 changes along a curved line extending from the upper right to the lower left in the CIE standard chromaticity diagram with being somewhat convex upward. It is supposed that this is because the ratio between the contributions of two light emitting layers 42 and 44 to the output from the LED element 22 changes in accordance with the driving current value.

Figure 5:
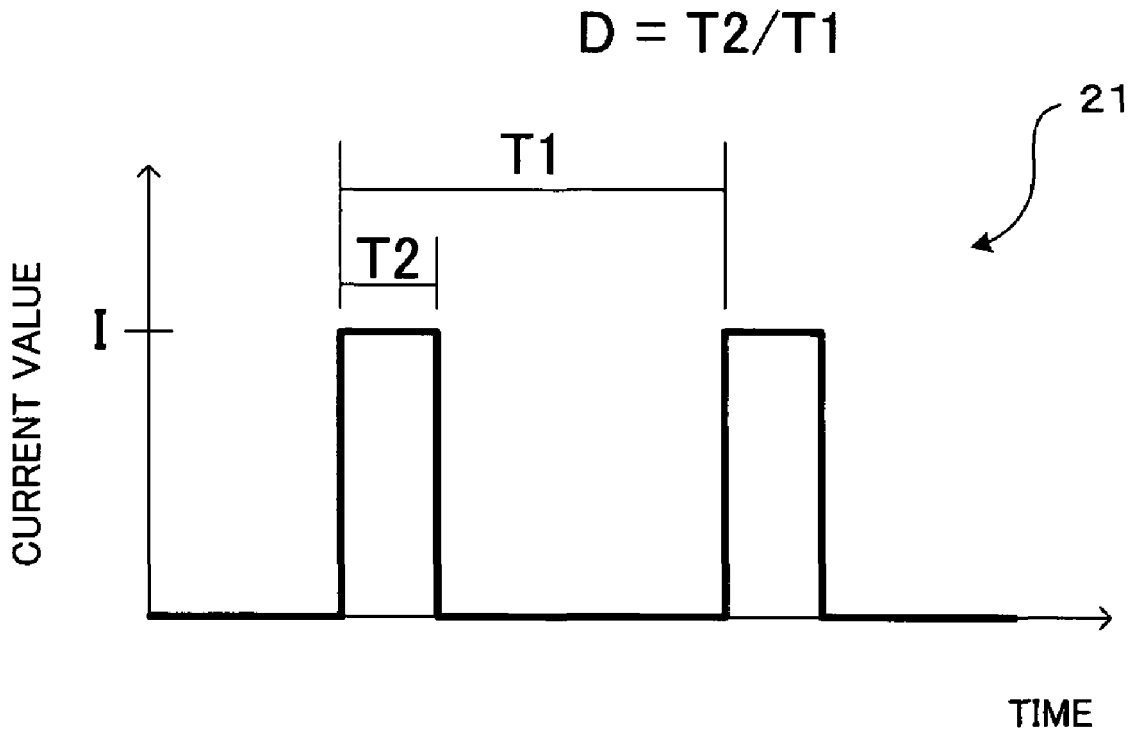
FIG. 5 is a waveform chart of a pulse current having a pulse height I and a duty D.

Next, a case wherein the LED element 22 is driven by a pulse current will be described. FIG. 5 schematically shows a pulse current of a square wave having a pulse height I and a duty D. The pulse height I indicates the current value of the pulse current. The duty D is defined by D=T2/T1 with the pulse cycle T1 and the pulse width T2.

In study by the inventors of the present invention, it was found that, even in case that the LED element 22 is driven by such a pulse current having the pulse height I and the duty D as shown in FIG. 5, the relation between driving current value and color of emitted light as shown in FIG. 4 is kept as it is if the current value is replaced by the pulse height I. That is, the color of emitted light from the LED element 22 being driven by the pulse current is substantially univocally determined by the pulse height I, i.e., the direct current value. But, if the heat radiation from the LED element 22 is extremely bad, a change in color tone occurs due to heat generation. However, the change is negligibly little.

A change in light emission efficiency and a change in luminosity of the LED element 22 in the range of the driving current value from 1 to 200 mA are not so wide as about 20% or less. Therefore, when the LED element 22 is driven by the pulse current, the product D×I of the duty D and the pulse height I, corresponding to the mean driving power, is substantially in proportion to the mean intensity of emitted light from the LED element 22 and the apparent brightness of the LED element 22. However, if the driving current value largely deviates from the range of 1 to 200 mA, the light emission efficiency of the LED element 22 largely varies from that when the driving current value is within the range from 1 to 200 mA. For example, if the driving current value is decreased from 1 mA to 0.01 mA, the light emission efficiency of the LED element 22 extremely decreases. In addition, if the color of emitted light varies, the luminosity also varies. Thus, in more general, the mean intensity of emitted light from the LED element 22 is represented by D×f[I]. The function f of the pulse height I represents the rate of relative change in the intensity of emitted light to a given current value, caused by changes in light emission efficiency and luminosity. That is, the function f represents a intensity of emitted light versus driving current value characteristics.

In this embodiment, the pulse current to be supplied to the LED element 22 preferably has a cycle T1 within a range in which any person observing emitted light from the LED 22 senses no flicker. For this reason, the cycle T1 of the pulse current is preferably 30 ms or less, more preferably, 10 ms or less. On the other hand, the pulse width T2 of the pulse current is preferably 1 ns or more, more preferably, 3 ns or more. This is because the light emitting layers 42 and 44 differs from each other in carrier life and the intensities of emitted lights from the light emitting layers 42 and 44 may widely differ from each other if the pulse width T2 is of the order of the carrier lives of the light emitting layers 42 and 44, for example, of the order of sub nanosecond to nanosecond in case of InGaN light emitting layers. Therefore, excessively shortening the cycle T1 of the pulse current is undesirable because it restricts the pulse width T2. In consideration of the above two factors, the frequency corresponding to the cycle T1 of the pulse current to be applied is preferably within the range from about 100 Hz to about 300 MHz. In case of using the illumination apparatus 1 of this embodiment as, for example, a backlight source for a liquid crystal panel, in addition to the above requests, it is required that the cycle T1 of the pulse current is sufficiently shorter than the time corresponding to the driving frequency of the liquid crystal panel.

As the technique for adjusting the duty D of the pulse current, any of the following techniques may be used: (a) the cycle T1 is kept constant and only the pulse width T2 is changed; (b) the pulse width T2 is kept constant and only the cycle T1 is changed; and (c) the number of pulses in a fixed time is changed. The pulse intervals of the pulse current need not be regular. A pulse current may be used in which pulses are concentrated in the first half of a certain period or in which pulses are concentrated in the second half of the period. That is, the pulse form, the pulse width, the number of pulses, etc., can be changed as far as the mean driving power of the LED element 22 corresponds to the desired intensity of emitted light. The duty D in case of irregular pulse intervals is defined by (the pulse width of one pulse)×(the number of pulses in a fixed period)/(the fixed period). Although each pulse included in the pulse current is square in this embodiment, the pulse waveform may have any shape other than the square shape if the color of emitted light can be substantially controlled by the pulse waveform.

The CIE standard chromaticity diagram showing a color of emitted light versus driving current value characteristics of FIG. 4 varies in accordance with the construction of the LED element 22. That is, the LED element 22 uses a specific active region 34. If the structure of the active region 34 is changed, the color of emitted light versus driving current value characteristics of the LED element 22 varies accordingly. However, the technique of this embodiment can be applied also to an illumination apparatus using, as a light source, an LED element different from that of this embodiment in the structure of the active region 34 if the illumination apparatus includes the LED element in which a plurality of light emitting layers, different from each other in light emission wavelength peak, put on each other with a barrier layer being interposed, are sandwiched by a pair of p-type and n-type layers, and the color of emitted light from which substantially depends only upon the driving current value.

(Details of LED Lighting Circuit)

Figure 6:
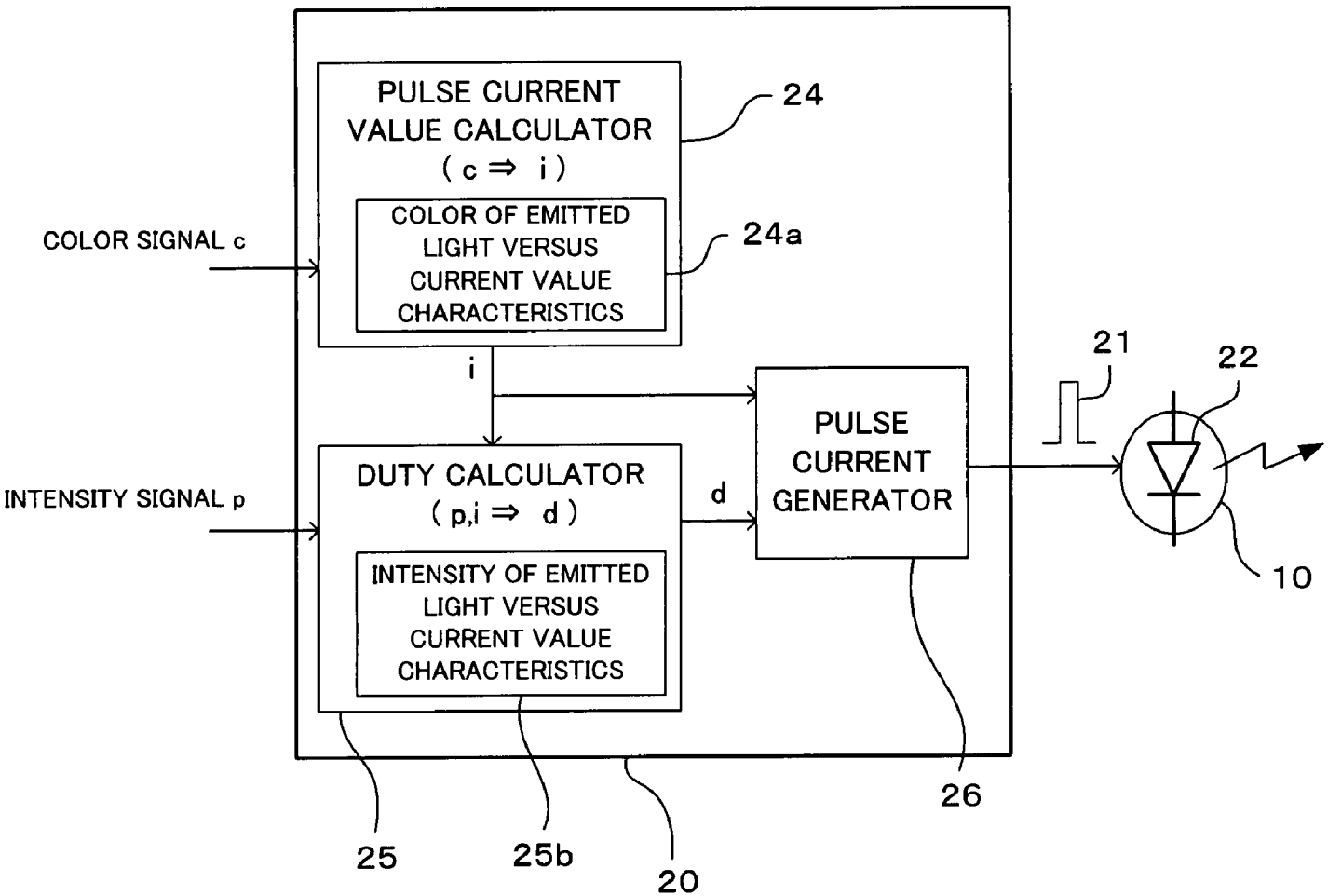
FIG. 6 is a block diagram of a control system of the illumination apparatus according to the Embodiment 1 of the present invention.

FIG. 6 shows a block diagram of a control system of the illumination apparatus 1 according to this embodiment. For simplifying the drawing, FIG. 6 shows only one of a large number of LED lamps 10. As shown in FIG. 6, the LED lighting circuit 20 receives an intensity signal p and a color signal c, and outputs a pulse current 21 having a pulse height I and a duty D as a square wave to be supplied to the LED lamp 10. In the illumination apparatus 1 of this embodiment, the intensity signal p and the color signal c are input to the LED lighting circuit 20 from a remote controller through the receiver 15. The intensity signal p is for designating the brightness of the illumination apparatus 1. The color signal c is for designating the color of emitted light.

The LED lighting circuit 20 includes therein a pulse current value calculator 24, a duty calculator 25, and a pulse current generator 26. The pulse current value calculator 24 obtains a pulse height signal i for designating the pulse height I of the pulse current, from the color signal c for designating a desired color of emitted light from the LED element 22. More specifically, the pulse current value calculator 24 converts the color signal c into the pulse height signal i in accordance with the color of emitted light versus driving current value characteristics data of the LED element 22 as shown in FIG. 4, which data is stored in an emitted-light color characteristics storage 24*a* provided in the pulse current value calculator 24.

The duty calculator 25 obtains a duty signal d for designating a duty D, from the intensity signal p for designating a desired intensity of emitted light from the LED element 22, and the pulse height signal i. More specifically, on the basis of the intensity signal p and the pulse height signal i, the duty calculator 25 obtains the duty signal d for designating a duty D, such that the product D×I of the duty D and the pulse height I designated by the pulse height signal i corresponds to the desired intensity of emitted light, designated by the intensity signal p.

In case that the pulse height I largely deviates from the range of 1 to 200 mA, on the basis of the intensity signal p and the pulse height signal i, the duty calculator 25 obtains the duty signal d for designating a duty D, such that the product D×f[I] of the duty D and a function value of the pulse height I designated by the pulse height signal i corresponds to the desired intensity of emitted light, designated by the intensity signal p. The function value f[I] can be obtained from the pulse height I designated by the pulse height signal i, by referring to the intensity of emitted light versus driving current value characteristics data of the LED element 22, which data is stored in an emitted-light intensity characteristics storage 25*b* provided in the duty calculator 25.

The pulse current generator 26 generates, as an LED driving current, a pulse current 21 having the pulse height I designated by the pulse height signal i obtained by the pulse current value calculator 24, and the duty D designated by the duty signal d obtained by the duty calculator 25. Thus, in the LED lighting circuit 20, various calculations are carried out using parameters, such as the color signal c, the pulse height signal i, the intensity signal p, and the duty signal d, to simplify the calculations. In addition, because the pulse height signal i for designating the pulse height I is determined and then the duty signal d for designating the duty D is determined, this makes it easy to control the intensity and color of emitted light from the LED element 22 the color of emitted light from which substantially depends only upon the driving current value.

Example 1 of Operation of LED Lighting Circuit

Figure 7:
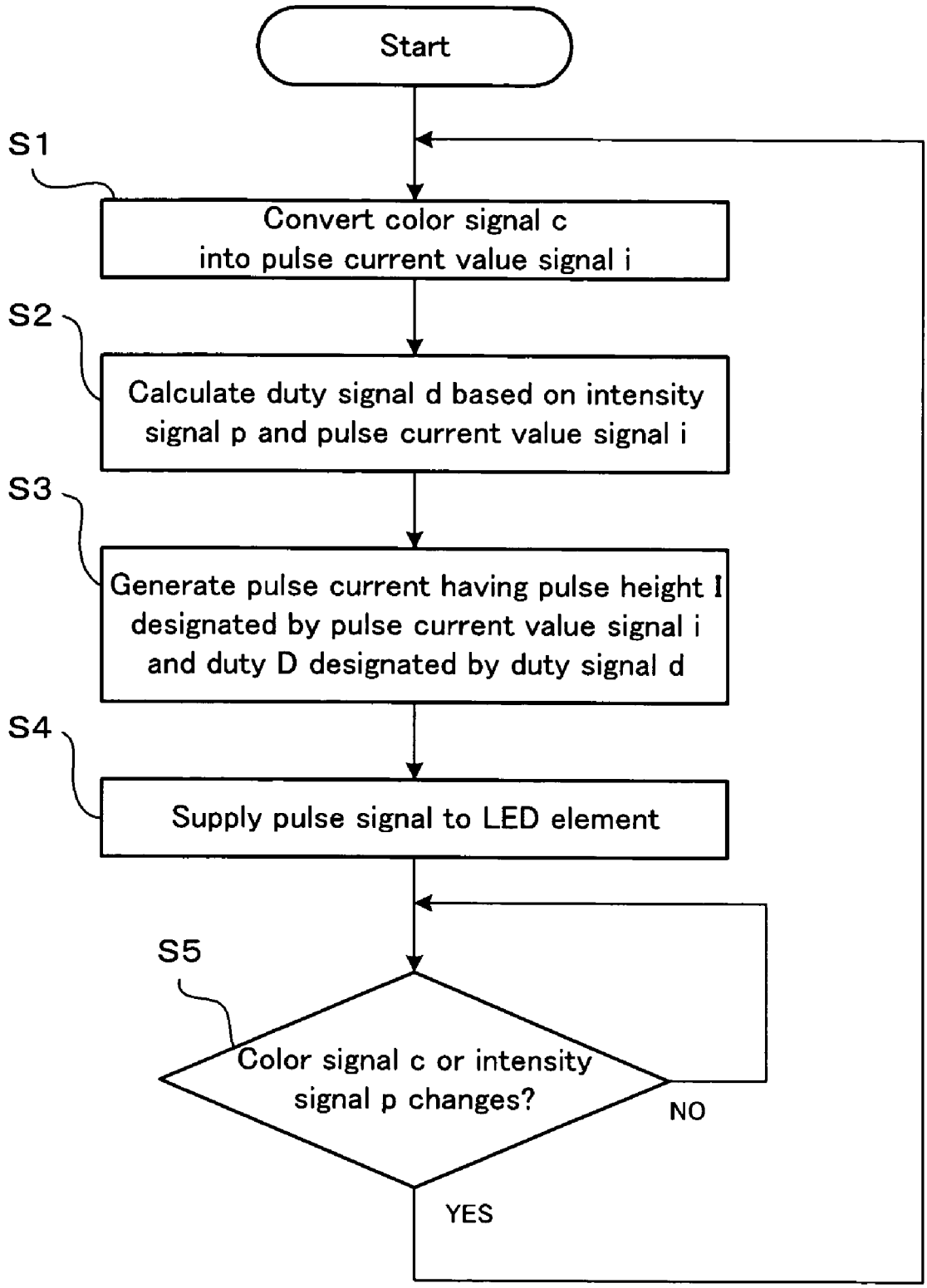
FIG. 7 is a flowchart showing an example of operation of the illumination apparatus according to the Embodiment 1 of the present invention.

Next, an example of operation of the illumination apparatus 1 around the LED lighting circuit 20 will be described with reference to the flowchart of FIG. 7. The LED lighting circuit 20 drives any LED lamp 10 mounted on the panel 11, under the same conditions. In this example, a case will be described wherein the illumination apparatus 1 is operated with a desired emitted-light color (x, y)=(0.33, 0.32) and a desired emitted-light intensity P=5. In this specification, the emitted-light intensity P is represented by an absolute number. The larger the number is, the higher the emitted-light intensity P is. The emitted-light intensity P=5 corresponds to the brightness when all the LED lamps 10 included in the illumination apparatus 1 are driven with a pulse height of 10 mA and a duty of 0.5.

On the basis of manual operation by an operator, a remote controller transmits, as wireless signals such as infrared signals, a color signal c for designating a desired emitted-light color of the illumination apparatus 1, that is, (x, y)=(0.33, 0.32), which signal is represented by c33 for convenience' sake, and an intensity signal p for designating a desired emitted-light intensity P=5 of the illumination apparatus 1, which signal is represented by p5 for convenience' sake. The receiver 15 receives the color signal c=c33 and the intensity signal p=p5. The color signal c=c33 and the intensity signal p=p5 received by the receiver 15 are input to the LED lighting circuit 20. Because the LED lighting circuit 20 drives any LED lamp 10 under the same conditions, the color signal c=c33 and the intensity signal p=p5 work as a color signal for designating a desired emitted-light color of each LED element 22, and an intensity signal for designating a desired emitted-light intensity of each LED element 22, respectively.

In a modification, in place of supplying the LED lighting circuit 20 with the color and intensity signals transmitted by wireless from the remote controller to the illumination apparatus 1, the LED lighting circuit 20 may be supplied with the color and intensity signals as electronic data stored in a memory device inside or outside the illumination apparatus 1, such as a semiconductor memory, a magnetic disk, or an optical disk. In another modification, the LED lighting circuit 20 may be supplied with the color and intensity signals as electric signals corresponding to resistance values of a variable resistor or resistors provided on an electric circuit inside or outside the illumination apparatus 1.

As described above, the pulse current value calculator 24 of the LED lighting circuit 20 converts the color signal c into a pulse height signal i in accordance with the color of emitted light versus driving current value characteristics data of the LED element 22 stored in the emitted-light color characteristics storage 24*a* in the pulse current value calculator 24, in Step S1. In case that the color signal c=c33 is input, because the current value corresponding to the emitted-light color (x, y)=(0.33, 0.32) is 10 mA, the pulse current value calculator 24 generates a pulse height signal i for designating a pulse height of 10 mA, which signal is represented by i10 for convenience' sake.

Next, as described above, on the basis of the intensity signal p and the pulse height signal i, the duty calculator 25 of the LED lighting circuit 20 obtains a duty signal d for designating a duty D, such that the product D×I of the duty D and the pulse height I designated by the pulse height signal i corresponds to the desired emitted-light intensity designated by the intensity signal p, by referring the intensity of emitted light versus driving current value characteristics data of the LED element 22 stored in the emitted-light intensity characteristics storage 25*b*, in Step S2. In case that the pulse height signal i10 and the intensity signal p5 are input, the duty calculator 25 calculates a duty D of 0.5 from an equation of (the pulse height I=10 mA designated by the pulse height signal i10)×D=(the desired emitted-light intensity P=5 designated by the intensity signal p5), and then generates a duty signal d for designating the duty D=0.5, which signal is represented by d0.5 for convenience' sake. In another example, in case of a pulse height signal i20, a duty signal d0.25 is obtained. In still another example, in case of a pulse height signal i6, a duty signal d0.83 is obtained.

Afterward, as described above, the pulse current generator 26 of the LED lighting circuit 20 generates, as an LED driving current, a pulse current 21 having the pulse height I designated by the pulse height signal i obtained by the pulse current value calculator 24, and the duty D designated by the duty signal d obtained by the duty calculator 25, in Step S3. In this example, a pulse current 21 having the pulse height I=10 mA and the duty D=0.5 is generated in accordance with the pulse height signal i10 and the duty signal d0.5. The LED lighting circuit 20 supplies the generated pulse current 21 to all LED elements 22 in the illumination apparatus 1, in Step S4. Thereby, all LED elements 22 emit lights in the same color corresponding to (x, y)=(0.33, 0.32) and at the same intensity corresponding to the emitted-light intensity P=5.

The LED lighting circuit is always monitoring whether or not the color signal c or intensity signal p being input changes, in Step S5. If one of them has changed, that is, YES in Step S5, the flow returns to Step S1 and the above-described procedure is repeated.

Thus, the LED lighting circuit 20 outputs a pulse signal 21 in which its pulse height I and duty D change in accordance with changes in color signal c and intensity signal p. Therefore, by using the LED lighting circuit 20, the intensity and color of emitted light from the illumination apparatus 1 can be controlled independently of each other. As a result, a phenomenon that a change in intensity of emitted light leads to a change in color of emitted light, which phenomenon is undesirable in a white light source, can be prevented from occurring on the illumination apparatus 1.

Example 2 of Operation of LED Lighting Circuit

As another example of operation, a case will be described wherein the desired emitted-light intensity P of the illumination apparatus 1 is switched over in the order of 7, 5, and 3 with time elapsing while the desired emitted-light color is kept at the color corresponding to (x, y)=(0.33, 0.32). In this case, although the color signal c being input to the LED lighting circuit 20 is fixed to c33, the intensity signal p changes in the order of p7, p5, and p3 in accordance with the change in the desired emitted-light intensity P. Therefore, this example of operation corresponds to a case wherein the flow of the flowchart of FIG. 7 returns from Step S5 to Step S1.

First, on the basis of the color signal c, the pulse current value calculator 24 of the LED lighting circuit 20 generates a pulse height signal i10 for designating the pulse height 10 mA, like Example 1. Next, on the basis of the intensity signal p7 and the pulse height signal i10, the duty calculator 25 of the LED lighting circuit 20 generates a duty signal d0.7 for designating the duty D=0.7, like Example 1. Afterward, the pulse current generator 26 of the LED lighting circuit 20 generates a pulse current 21 having the pulse height 10 mA designated by the pulse height signal i10 and the duty D=0.7 designated by the duty signal d0.7, like Example 1. The LED lighting circuit supplies the generated pulse current 21 to all LED elements 22 in the illumination apparatus 1.

Afterward, when the intensity signal p changes to p5, the duty signal changes from d0.7 to d0.5 though the pulse height signal i10 is kept as it is. Attendant upon this, the duty D of the pulse current 21 generated by the pulse current generator 26 becomes 0.5. Afterward, when the intensity signal p changes to p3, the duty signal changes from d0.5 to d0.3 though the pulse height signal i10 is kept as it is. Attendant upon this, the duty D of the pulse current 21 generated by the pulse current generator 26 becomes 0.3. Thus, the pulse current 21 is a current in which its duty D changes in the order of 0.7, 0.5, and 0.3 in accordance with the change in the desired emitted-light intensity P with keeping its pulse height at 10 mA. As a result, in the illumination apparatus 1 being driven by the pulse current 21, the emitted-light intensity P decreases in the order of 7, 5, and 3 with time elapsing with keeping the emitted-light color at the color corresponding to (x, y)=(0.33, 0.32).

Example 3 of Operation of LED Lighting Circuit

As still another example of operation, a case will be described wherein the desired emitted-light color of the illumination apparatus 1 is switched over from the color corresponding to (x, y)=(0.38, 0.35), i.e., white inclining to yellow, to the color corresponding to (x, y)=(0.26, 0.28), i.e., white inclining to blue, and the desired emitted-light intensity is switched over from 4 to 7 in accordance with the switchover of the emitted-light color. In this example of operation, the color signal c and the intensity signal p being input to the LED lighting circuit 20 change. Thus, this example of operation also corresponds to a case wherein the flow of the flowchart of FIG. 7 returns from Step S5 to Step S1. In this case, a set of color signal c and intensity signal p being input to the LED lighting circuit 20 is switched over from a set of color signal c38 and intensity signal p4 to a set of color signal c26 and intensity signal p7.

First, on the basis of the color signal c38, the pulse current value calculator 24 of the LED lighting circuit 20 generates a pulse height signal i5 for designating the pulse height 5 mA, like Example 1. Next, on the basis of the intensity signal p4 and the pulse height signal i5, the duty calculator 25 of the LED lighting circuit 20 generates a duty signal d0.8 for designating the duty D=0.8, like Example 1. Afterward, the pulse current generator 26 of the LED lighting circuit 20 generates a pulse current 21 having the pulse height 5 mA designated by the pulse height signal i5 and the duty D=0.8 designated by the duty signal d0.8, like Example 1. The LED lighting circuit supplies the generated pulse current 21 to all LED elements 22 in the illumination apparatus 1.

Afterward, when the color signal c and the intensity signal p change to c26 and p7, respectively, the pulse current value calculator 24 generates, on the basis of the color signal c26, a pulse height signal i100 for designating the pulse height 100 mA. Next, on the basis of the intensity signal p7 and the pulse height signal i100, the duty calculator 25 generates a duty signal d0.07 for designating the duty D=0.07. Afterward, the pulse current generator 26 generates a pulse signal 21 having the pulse height 100 mA designated by the pulse height signal i100 and the duty D=0.07 designated by the duty signal d0.07. The LED lighting circuit 20 supplies the generated pulse current 21 to all LED elements 22 in the illumination apparatus 1. Thus, the pulse current 21 is a current in which both of the pulse height I and the duty D are switched over at a certain time. As a result, the illumination apparatus 1 being driven by the pulse current 21 changes over from a state wherein the emitted-light color is white inclining to yellow and the emitted-light intensity P is 4, to a state wherein the emitted-light color is white inclining to blue and the emitted-light intensity P is 7.

As described above, in this example of operation in which the emitted-light color of the illumination apparatus 1 is discretely changed, the pulse height is changed by twenty times from 5 mA to 100 mA. This is for making an observer distinctly sense the change in color tone. From this viewpoint, the pulse height I of the pulse current 21 is changed preferably by 10 times or more, more preferably, by 20 times or more.

Figure 14:
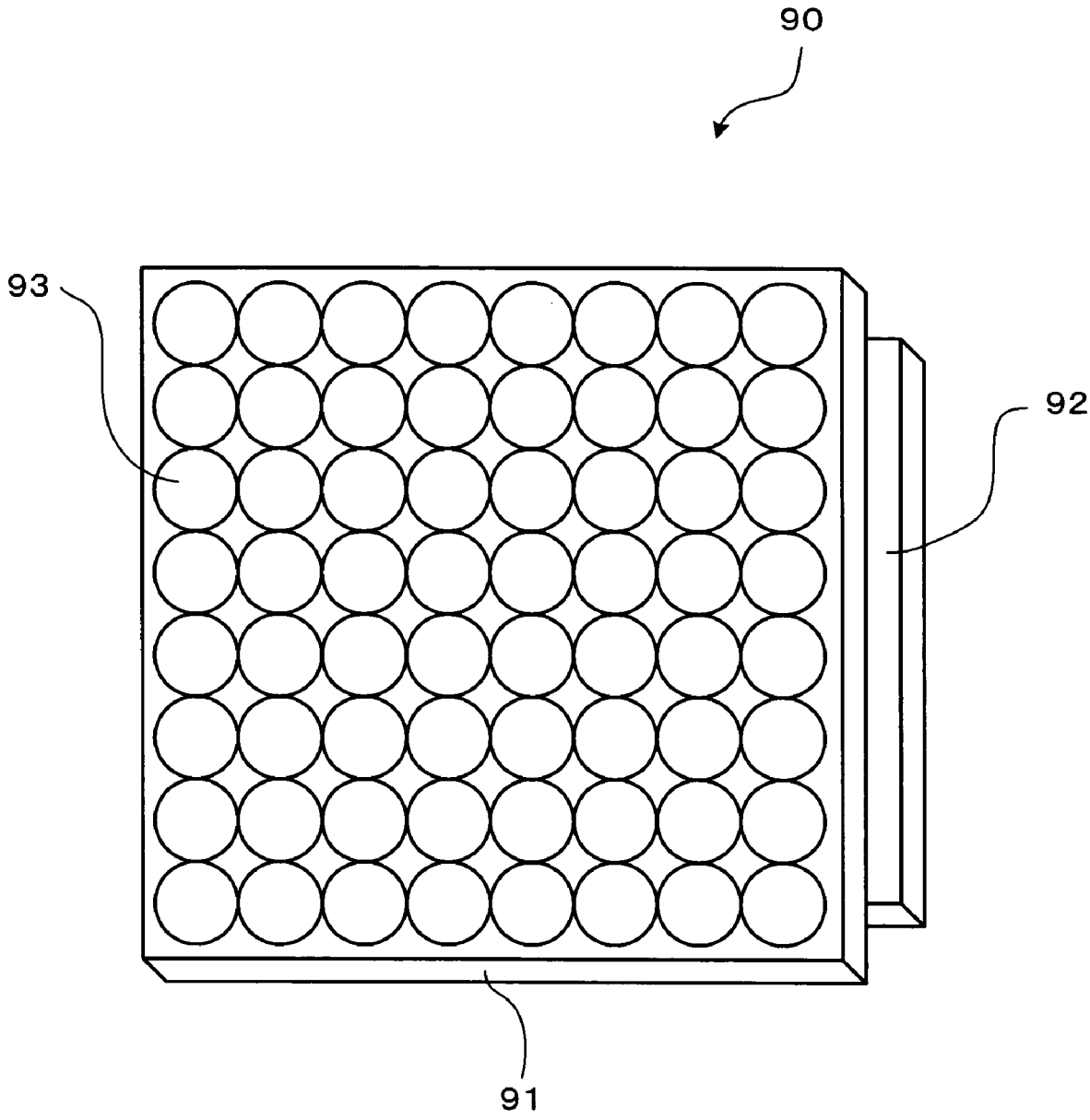
FIG. 14 is an external view of a display apparatus according to Embodiment 5 of the present invention.
Figure 15:
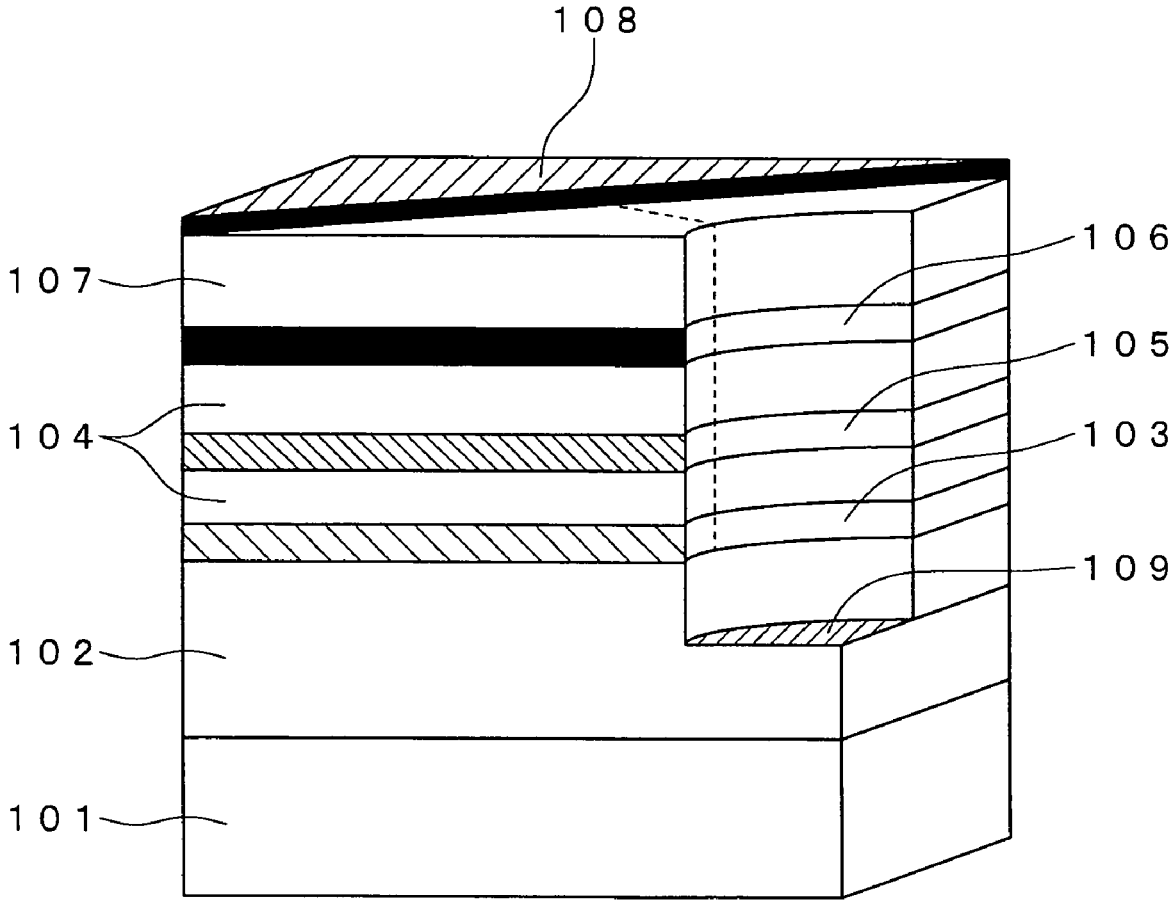
FIG. 15 is a schematic perspective view of an LED element disclosed in JP-A-11-121806.

In Example 2 of operation, a case was described wherein only the intensity of emitted light is changed. In Example 3 of operation, a case was described wherein both the color and intensity of emitted light are changed. In another example of operation, only the color of emitted light may be changed with the intensity of emitted light being unchanged. If a driving method of this example is applied to a display apparatus as will be described in Embodiment 5 with reference to FIG. 14, a display apparatus high in visual effect can be realized in a simple construction. In still another example of operation, the color signal c being input to the LED lighting circuit 20 may be continuously changed with time elapsing to continuously change the color of emitted light from the illumination apparatus 1.

Embodiment 2

Next, an illumination apparatus according to Embodiment 2 of the present invention will be described. Because the illumination apparatus of this embodiment is similar to the illumination apparatus of Embodiment 1, only difference from the Embodiment 1 will be mainly described here. In this embodiment, the same components as in the Embodiment 1 are denoted by the same reference numerals as in the Embodiment 1, respectively, to omit the description thereof.

Figure 8:
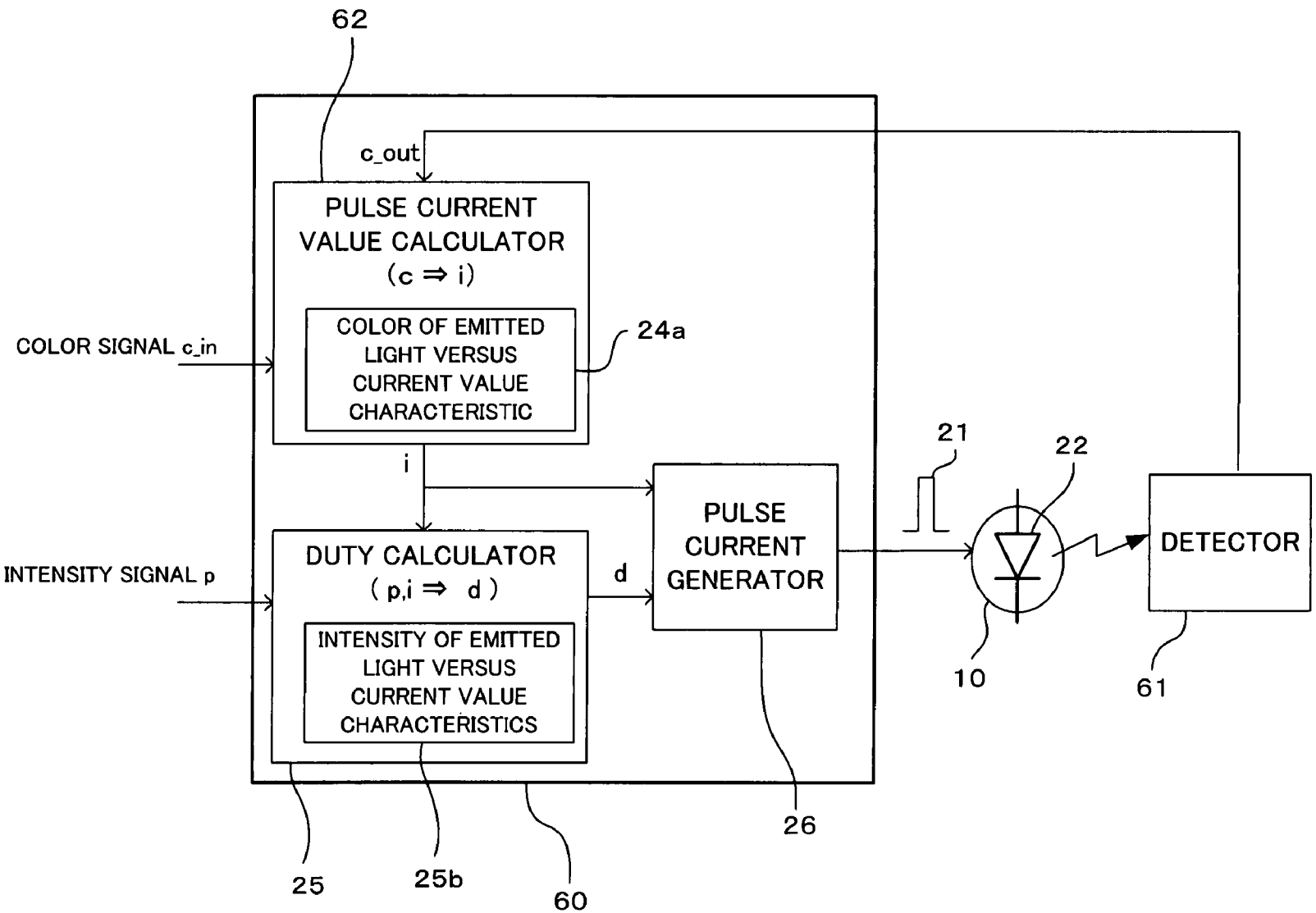
FIG. 8 is a block diagram of a control system of an illumination apparatus according to Embodiment 2 of the present invention.

FIG. 8 shows a block diagram of a control system of the illumination apparatus according to this embodiment. For simplifying the drawing, FIG. 8 shows only one of a large number of LED lamps 10. An LED lighting circuit 60 of FIG. 8, corresponding to the LED lighting circuit 20 of Embodiment 1, includes therein a pulse current value calculator 62, a duty calculator 25, and a pulse current generator 26. A detector 61 is disposed near the LED lamp 10 for receiving a light from the LED lamp 10 and generating an output color signal c_out in accordance with the color of the received light. The output color signal c_out from the detector 61 is input, as a feedback signal of the color of emitted light from the LED element 22, to the pulse current value calculator 62 together with an input color signal c_in given from a-remote controller for designating a desired color of emitted light from the LED element 22.

In accordance with the color of emitted light versus driving current value characteristics data of the LED element 22 stored in an emitted-light color characteristics storage 24*a*, the pulse current value calculator 62 makes feedback control on the basis of the input color signal c_in and the output color signal c_out, and obtains a pulse height signal i for designating a pulse height I of the pulse current 21, such that the color of emitted light from the LED element 22 becomes the desired color designated by the input color signal c_in. Because the output color signal c_out changes serially, the pulse height signal i output by the pulse current value calculator 62 also changes serially. Like Embodiment 1, the duty calculator 25 obtains a duty signal d and the pulse current generator 26 generates a pulse current 21 having the pulse height I and the duty D. The pulse current 21 is a current in which its pulse height I and duty D change serially as the pulse height signal i changes serially. Thereby, inconvenience can be suppressed in which the color of emitted light from the LED element 22 largely deviates from the desired color designated by the input color signal c_in. As a result, the illumination apparatus can be operated substantially in a fixed color near the desired color.

Embodiment 3

Next, an illumination apparatus according to Embodiment 3 of the present invention will be described. Because the illumination apparatus of this embodiment is similar to the illumination apparatus of Embodiment 1, only difference from the Embodiment 1 will be mainly described here. In this embodiment, the same components as in the Embodiment 1 are denoted by the same reference numerals as in the Embodiment 1, respectively, to omit the description thereof.

Figure 9:
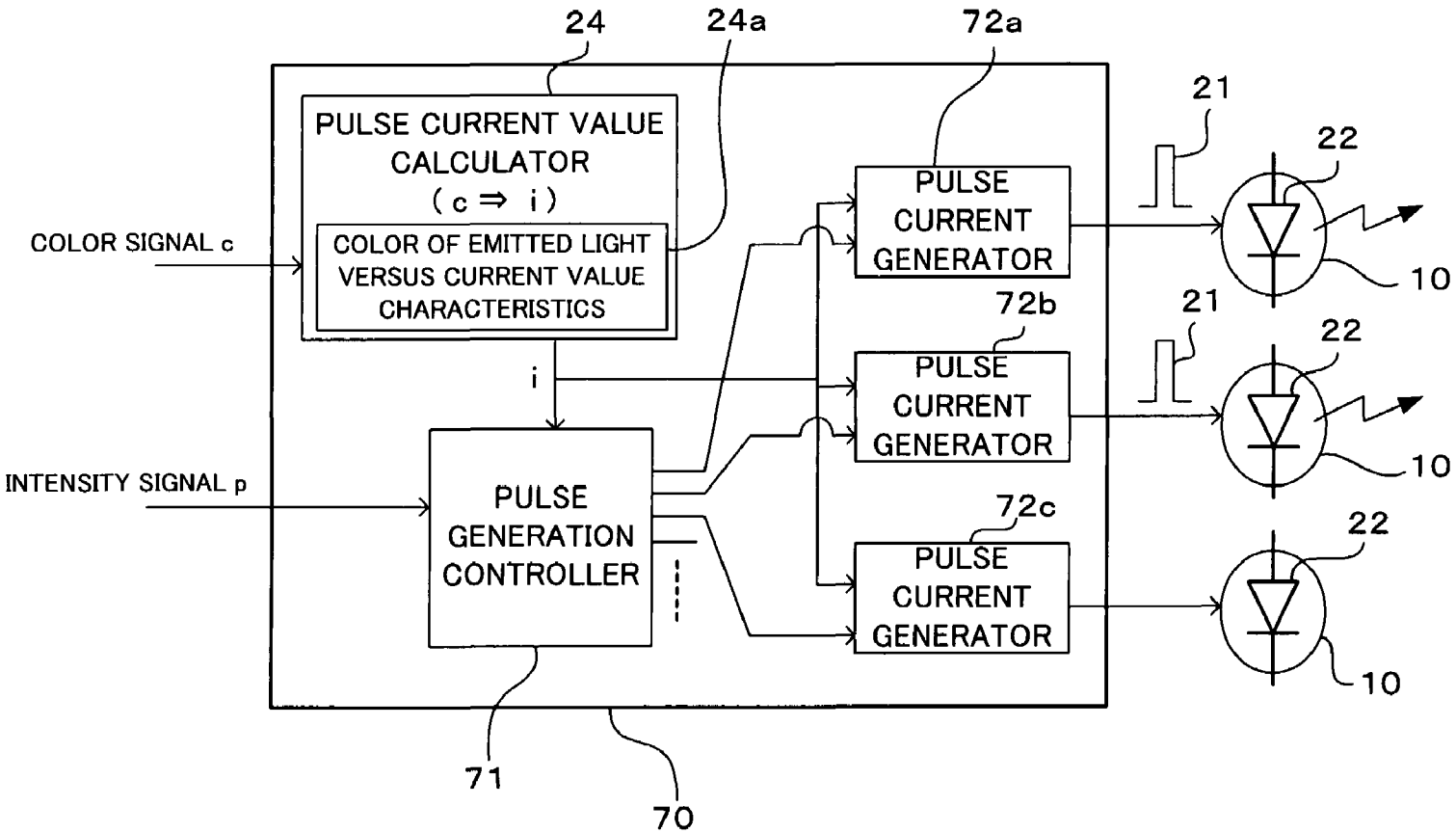
FIG. 9 is a block diagram of a control system of an illumination apparatus according to Embodiment 3 of the present invention.

FIG. 9 shows a block diagram of a control system of the illumination apparatus according to this embodiment. For simplifying the drawing, FIG. 9 shows only three of a large number of LED lamps 10. An LED lighting circuit 70 of FIG.

9, corresponding to the LED lighting circuit 20 of Embodiment 1, includes therein a pulse current value calculator 24, a pulse generation controller 71, and pulse current generators in the same number as LED lamps 10, though FIG. 9 shows only three pulse current generators 72*a*, 72*b*, and 72*c* in the same number as three LED lamps 10. The pulse current value calculator 24 converts a color signal c into a pulse height signal i in accordance with the color of emitted light versus driving current value characteristics data of an LED element 22 stored in an emitted-light color characteristics storage 24*a*.

From an intensity signal p for designating a desired intensity of emitted light from an LED element 22, and the pulse height signal i, the pulse generation controller 71 calculates the number of LED lamps 10 to be driven for obtaining the desired intensity of emitted light when each LED lamp 10 is driven by a pulse current having a pulse height I designated by the pulse height signal i, and a predetermined duty D0. The pulse generation controller 71 outputs a lighting instruction signal only to the pulse current generators corresponding to the calculated number of LED lamps 10. In the example of FIG. 9, the lighting instruction signal is output to only two pulse current generators 72*a* and 72*b* of three pulse current generators 72*a*, 72*b*, and 72*c*.

Each of the pulse current generators 72*a* and 72*b* having been input with the lighting instruction signal, generates a pulse signal 21 having the pulse height I designated by the pulse height signal i given from the pulse current value calculator 24, and the predetermined duty D0. The generated pulse signal 21 is supplied to the corresponding LED lamp 10. The number of LED lamps 10 to be supplied with the pulse current 21 varies in accordance with a change in value of the intensity signal p. Therefore, the intensity of emitted light from the illumination apparatus having therein a large number of LED lamps 10 can be controlled without changing the duty D of pulse.

By using the driving method of this embodiment, a merit can be obtained in which the range of combination of the color and intensity of light that an illumination apparatus can emit, can be extended. For example, a color of emitted light, that can not be obtained at a high intensity by a single LED lamp 10 because of its corresponding pulse height smallness, can be obtained at a sufficiently high intensity.

Embodiment 4

Figure 10:
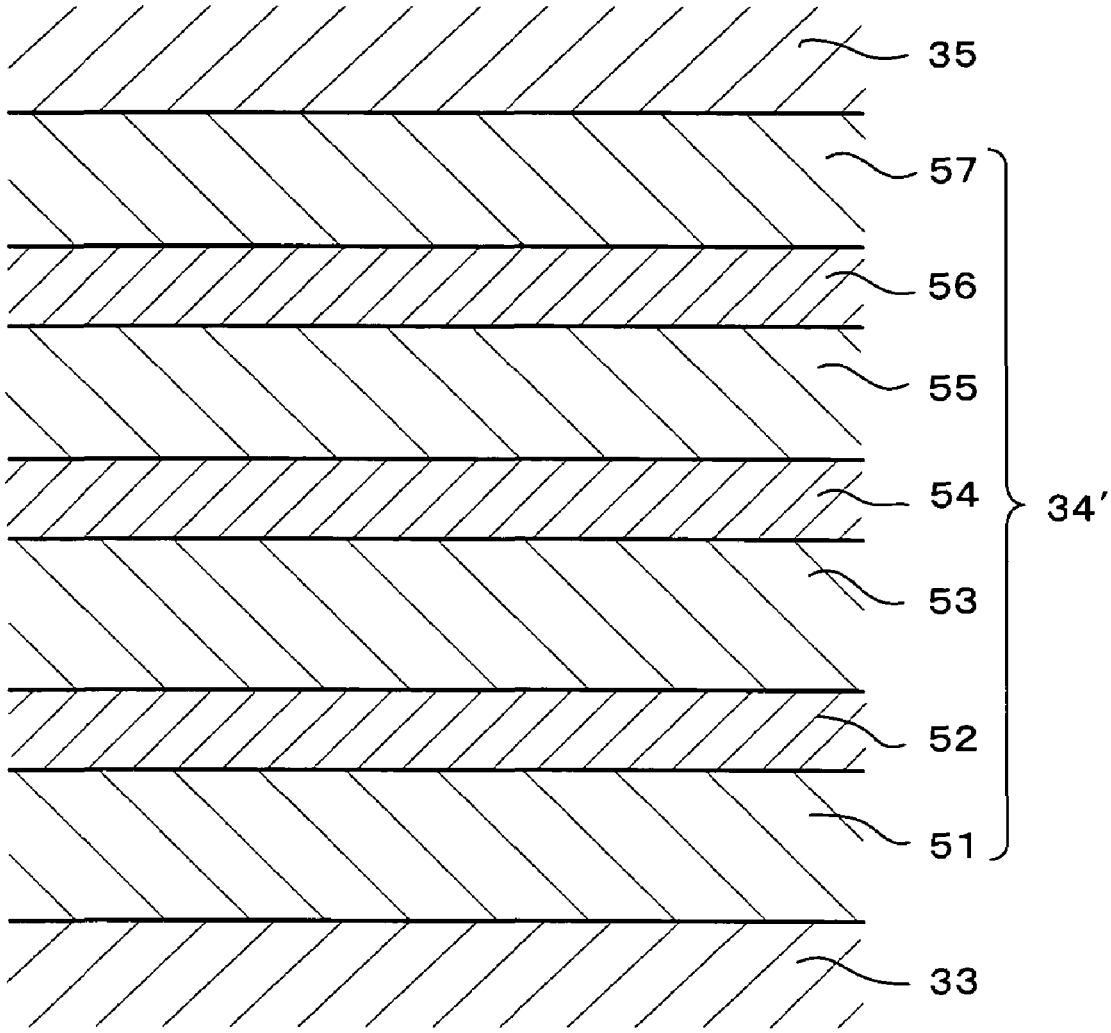
FIG. 10 is a schematic sectional view of an active region of an LED element included in an illumination apparatus according to Embodiment 4 of the present invention.

Next, an illumination apparatus according to Embodiment 4 of the present invention will be described. In this embodiment, the same components as in Embodiment 1 are denoted by the same reference numerals as in the Embodiment 1, respectively, to omit the description thereof. An LED element included in the illumination apparatus of this embodiment differs from those of Embodiments 1 to 3 in the structure of the active region. FIG. 10 shows a schematic sectional view of an active region 34' of an LED element included in the illumination apparatus of this embodiment. As shown in FIG. 10, the active region 34' is made up of an InGaN barrier layer 51, an InGaN blue light emitting layer 52, an InGaN barrier layer 53, an InGaN green light emitting layer 54, an InGaN barrier layer 55, an InGaN red light emitting layer 56, and an InGaN barrier layer 57, which are put on each other in this order from the sapphire substrate 31 side. That is, the active region 34' has a three-layer multi quantum well (MQW) structure in which three light emitting layers 52, 54, and 56 different from each other in light emission wavelength peak are disposed in series.

Figure 11:
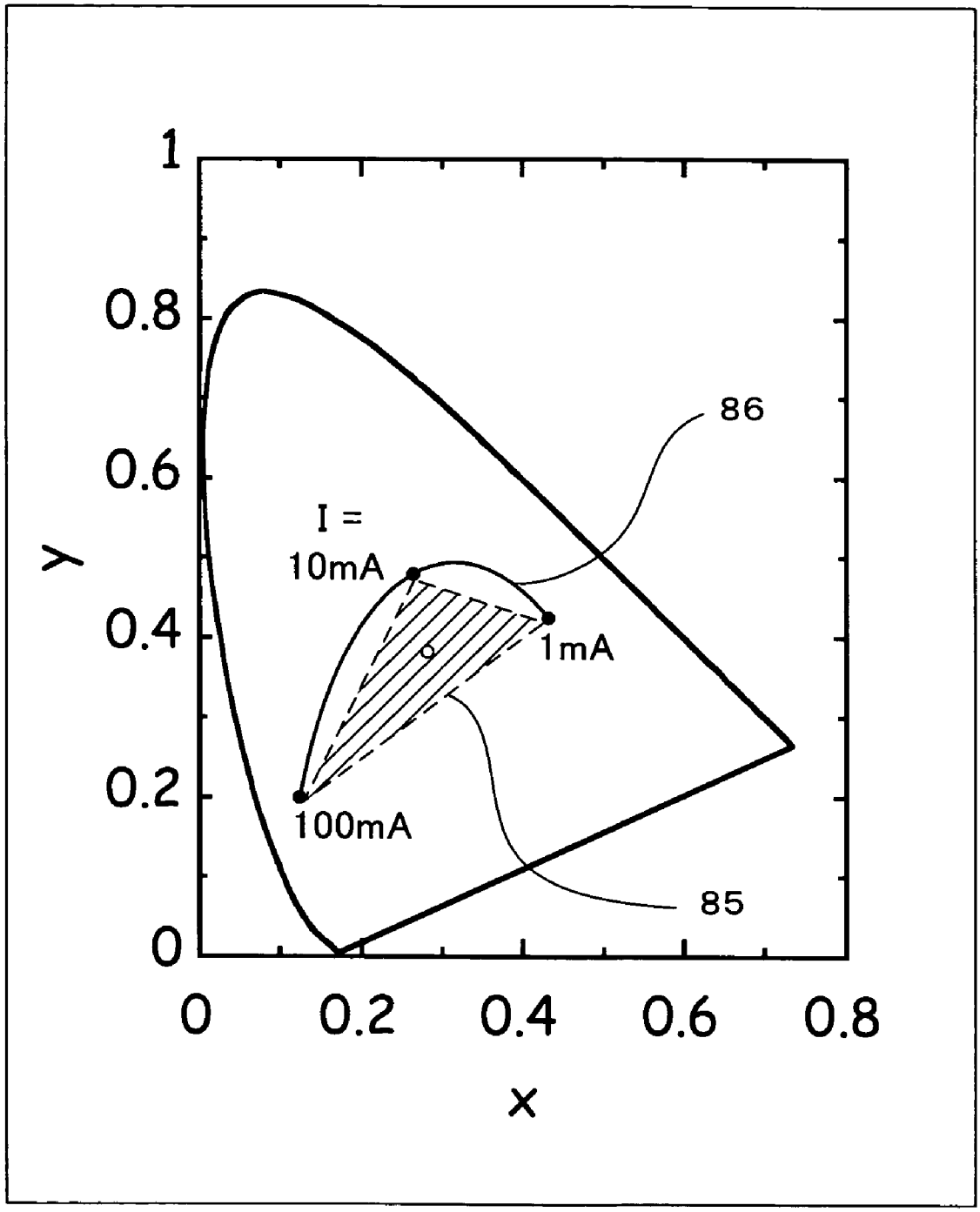
FIG. 11 is a CIE standard chromaticity diagram showing a color of emitted light versus driving current value characteristics of the LED element having the active region as shown in FIG. 10.

FIG. 11 is a CIE standard chromaticity diagram showing a relation between driving current value and color of emitted light when an LED element having the active region 34' as shown in FIG. 10 is driven by a constant direct current, that is, the color of emitted light versus driving current value characteristics. A line 86 in FIG. 11 represents a locus showing a change in color of emitted light as the driving current value is changed from 1 mA to 100 mA. For example, when the driving current is 1 mA, the color of emitted light is white corresponding to (x, y)=(0.42, 0.43). As the current increases, the influences of green and blue light emissions become intensive. When the driving current is 10 mA, the color of emitted light becomes white corresponding to (x, y)=(0.25, 0.48). When the driving current is 100 mA, the color of emitted light becomes white inclining to blue, corresponding to (x, y)=(0.13, 0.20). Thus, as the current value increases, the color of emitted light from the LED element having the active region 34' changes along a parabola convex upward with an apex at a driving current value of 5 to 8 mA in the CIE standard chromaticity diagram. Therefore, even if the LED element is driven by a driving current having a constant value, the LED element never emits, for example, a white light of (x, y)=(0.28, 0.38) indicated by a white circle in the CIE standard chromaticity diagram of FIG. 11.

In this embodiment, three emitted-light colors of (x, y)= (0.42, 0.43), (0.25, 0.48), and (0.13, 0.20), corresponding to current values 1 mA, 10 mA, and 100 mA, are referred to as base colors α, β, and γ, respectively. These three emitted-light colors are examples of the base colors α, β, and γ. In a modification, another color of emitted light may be used as a base color.

Figure 12:
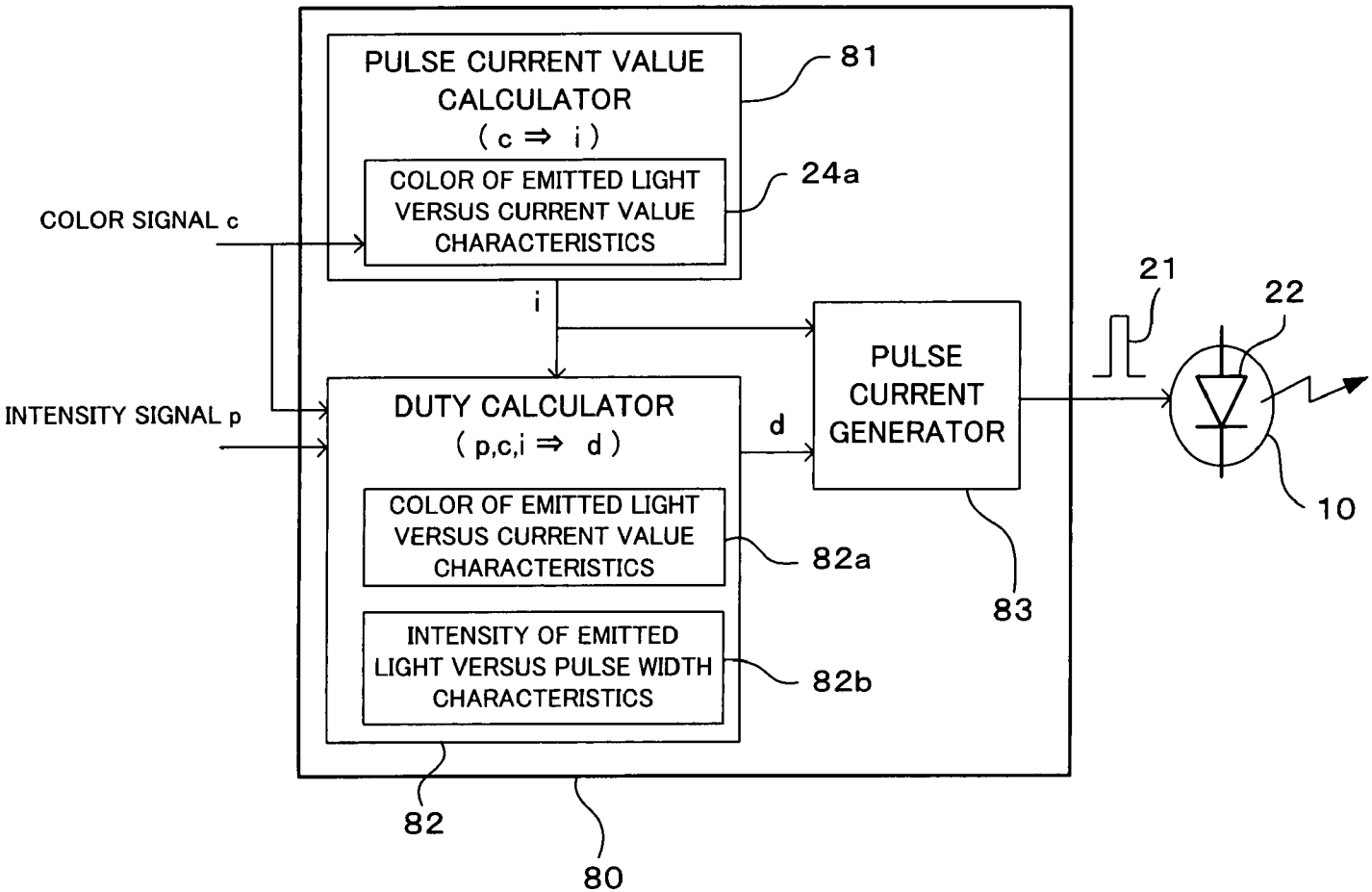
FIG. 12 is a block diagram of a control system of the illumination apparatus according to the Embodiment 4 of the present invention.

FIG. 12 shows a block diagram of a control system of the illumination apparatus according to this embodiment. For simplifying the drawing, FIG. 12 shows only one of a large number of LED lamps 10. As shown in FIG. 12, an LED lighting circuit 80 receives an intensity signal p and a color signal c, and outputs a pulse current 21 to be supplied to the large number of LED lamps 10.

Figure 13:
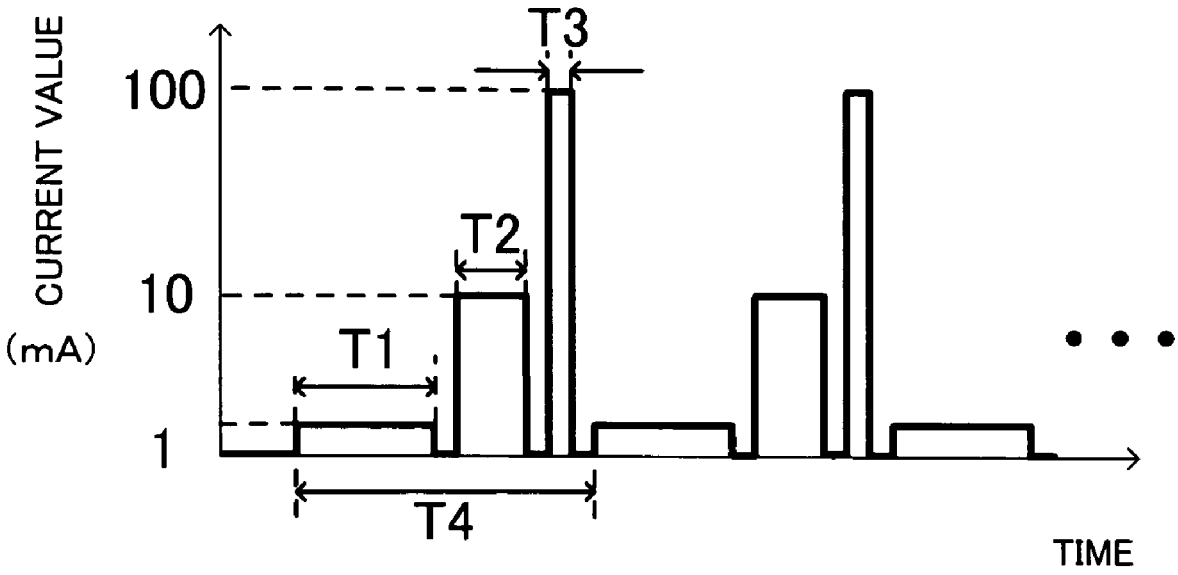
FIG. 13 is a waveform chart of a pulse current generated by an LED lighting circuit as shown in FIG. 12.

FIG. 13 shows a waveform of the pulse current 21 of this embodiment. In the pulse current 21, as shown in FIG. 13, three pulses having pulse heights 1 mA, 10 mA, and 100 mA, corresponding to the base colors α, β, and γ, respectively, appear repeatedly in this order. When the cycle T4 of the pulse current 21 is defined by the time period from the rising edge of a pulse of the pulse height 1 mA to the rising edge of the next pulse of the pulse height 1 mA, the duty Da of a pulse having its pulse width T1, corresponding to the base color α, is represented by T1/T4; the duty Db of a pulse having its pulse width T2, corresponding to the base color β, is represented by T2/T4; and the duty Dc of a pulse having its pulse width T3, corresponding to the base color γ, is represented by T3/T4.

The LED lighting circuit 80 includes therein a pulse current value calculator 81, a duty calculator 82, and a pulse current generator 83. The pulse current value calculator 81 obtains three pulse height signals ia, ib, and ic for designating the pulse heights I corresponding to the base colors α, β, and γ, respectively, from the color signal c for designating the desired color of emitted light from the LED element, in accordance with the color of emitted light versus driving current value characteristics data of the LED element as shown in FIG. 11 stored in an emitted-light color characteristics storage 24*a*.

The duty calculator 82 obtains duty signals da, db, and dc for designating the duties Da to Dc of three pulses of the pulse widths T1 to T3, respectively, from the color signal c, the intensity signal p for designating the desired intensity of emitted light from the LED element, and the pulse height signals i. More specifically, on the basis of the color signal c, the intensity signal p, and the pulse height signals ia to ic, the duty calculator 82 obtains the duty signals da, db, and dc for designating the duties Da, Db, and Dc, such that the sum of the product (Da×Ia) of the duty Da and the pulse height Ia designated by the pulse height signal ia, 1 mA in this example; the product (Db×Ib) of the duty Db and the pulse height Ib designated by the pulse height signal ib, 10 mA in this example; and the product (Dc×Ic) of the duty Dc and the pulse height Ic designated by the pulse height signal ic, 100 mA in this example, corresponds to the desired emitted-light intensity designated by the intensity signal p, while making control so that the observer senses the emitted-light color designated by the color signal c, by mixing the base colors α, β, and γ. At this time, the duty calculator 82 refers to a color of emitted light versus driving current value characteristics data of the LED element stored in an emitted-light color characteristics storage 82*a*, and an intensity of emitted light versus pulse width on each base color characteristics data stored in an emitted-light intensity characteristics storage 82*b*.

The pulse current generator 83 generates, as an LED driving current, a pulse current 21 in which three pulses having the pulse heights Ia, Ib, and Ic designated by the pulse height signals ia, ib, and ic obtained by the pulse current value calculator 81, and the duties Da, Db, and Dc designated by the duty signals da, db, and dc obtained by the duty calculator 82, respectively, appear repeatedly in order.

In this embodiment, any of the pulse widths T1, T2, and T3 and the cycle T4 is sufficiently short as about 10 ms or less. Thus, when the LED element having the characteristics of FIG. 11 is driven by the pulse current 21 as shown in FIG. 13, the eyes of a person can not sense separately the three base colors of light emitted from the LED element and he or she feels as if the LED element is emitting light of a single color obtained by mixing the base colors, i.e., white light. The color of emitted light from the LED element is determined by the ratio in emitted-light intensity among three base colors. The emitted-light intensities of the base colors can be controlled independently of one another by changing electric powers to be applied, that is, the pulse widths T1, T2, and T3. Thus, the color of emitted light from the LED element can be adequately controlled. As a result, in this embodiment, even in case that drive by a driving current having a constant value, such as the normal pulse driving current of FIG. 5, can not make the LED element emit light of a desired color, it becomes possible to make the observer feel as if the LED element can emit light of any color within a triangular region 85 enclosed by lines interconnecting the base colors, in the CIE standard chromaticity diagram of FIG. 11. For example, white of (x, y)=(0.28, 0.38), indicated by a white circle in the CIE standard chromaticity diagram of FIG. 11, can be obtained. Further, even in case that drive by a driving current having a constant value can make the LED element emit light of a desired color, use of a driving current in which pulses having different pulse heights are combined, as in this embodiment, can make the observer feel as if the LED element is emitting light of the desired color.

In this embodiment, if the pulse cycle T4 is changed while the pulse widths T1, T2, and T3 are fixed, the intensity of emitted light of a mixed color can be controlled with keeping the color of emitted light constant. Therefore, a merit can be obtained that the intensity of emitted light can be controlled even in case of making the observer feel as if the LED element is emitting light of a color obtained by mixing a plurality of colors. In this embodiment, because three pulses of the pulse widths T1, T2, and T3 appear in order in the pulse current 21, the LED element emits lights of a plurality of colors in order. As a result, even in case that the desired intensity of emitted light from the LED element is high and the duty D of each pulse is large, the observer is hard to feel flicker.

Further, because three colors α, β, and γ are used as base colors, a relatively wide range of color to be sensed by the observer is obtained. In this embodiment, from a viewpoint that a larger number of emitted-light colors different from one another are obtained, points on the CIE standard chromaticity diagram, the distances between which are as large as possible, are preferably selected as base colors. However, if the current value corresponding to a base color is too small, the pulse width must be considerably increased for obtaining a required intensity of emitted light and the pulse cycle T4 also can not but be increased. Because a pulse cycle T4 of about 10 ms or more may cause the observer to feel flicker, each base color is preferably selected such that the corresponding current value is not so small. In consideration of the above points, base colors may be selected in accordance with application. In this embodiment, the number of base colors is three. In modifications, however, only two base colors or four or more base colors may be selected.

Embodiment 5

Next, a display as a display apparatus according to Embodiment 5 of the present invention will be described. The display 90 shown in FIG. 14 includes therein a display main body 91 on which a large number of LED lamps 93 are arranged in X and Y directions in a matrix, and an LED lighting circuit block 92 disposed behind the display main body 91. Each LED lamp 93 includes therein an LED element as described with reference to FIGS. 2 and 3. The LED lighting circuit block 92 has thereon LED lighting circuits 20, as shown in FIG. 6, in the same number as the LED lamps 93. Each LED lighting circuit 20 of the LED lighting circuit block 92 controls the color and intensity of light emitted from the corresponding one LED lamp 93.

Each LED lamp 93 includes therein the LED element 22 having a complicated construction in which two InGaN light emitting layers different from each other in light emission wavelength peak are sandwiched by a pair of p-type and n-type layers. Therefore, unevenness of characteristics is apt to occur due to delicate variation in conditions in the manufacture process. However, by driving each LED lamp 93 in accordance with its characteristics as in this embodiment, any LED lamp 93 included in the display 90 can be driven to emit light in the same desired color at the same desired intensity. More specifically, in each LED lighting circuit 20, a color of emitted light versus driving current value characteristics data of the corresponding LED element 22 has been stored in the emitted-light color characteristics storage 24*a* in the pulse current value calculator 24, and an intensity of emitted light versus driving current value characteristics data of the corresponding LED element 22 has been stored in the emitted-light intensity characteristics storage 25*b* in the duty calculator 25. Thereby, even if some LED elements 22 are uneven in characteristics, pulse height signals i and duty signals d in which the unevenness in characteristics has been compensated, can be obtained. Therefore, even if some LED lamps 93 are uneven in characteristics, any LED lamp 93 can be driven to emit light in the same desired color at the same desired intensity. As a result, the quality of an image displayed on the display 90 can be improved. Further, in the display 90 of this embodiment, because the color and intensity of emitted light can be controlled independently of each other, a high visual effect can be obtained that the color of emitted light from the display 90 can be changed without changing the intensity of the emitted light. In addition, the display 90 of this embodiment has a merit that the construction is simple.

In a modification, each of the LED lamps 93 may be driven to emit light in a desired color determined individually for the LED lamp 93, at a desired intensity determined individually for the LED lamp 93. In another modification, the LED lighting circuit block 92 of the display 90 of this embodiment may include therein LED lighting circuits according to another embodiment, for example, Embodiment 2 or 4. In still another modification, each LED lamp 93 may include therein an LED element having three light emitting layers different from one another in light emission wavelength peak, as described in Embodiment 4.

Other Modifications

In the above embodiments, for making the explanation plain, a case has been described wherein the driving current I and the emitted-light intensity P of each LED element are in proportion to each other, that is, $P=A\times I\times D$, where A is a constant. However, the present invention is not limited to a case of driving such an LED element. If the emitted-light intensity of each LED element can be represented by a function of the driving current I and the duty D, that is, $P=D\times f[I]$ or $P=f'[I, D]$, where the function f' represents an emitted-light intensity to a given driving current I and duty D, the present invention can be applied. Such a function f or f' may have been stored in advance as a table in a storage device.

In the above embodiments, each LED lighting circuit 20 carries out various calculations using parameters such as a color signal c, a pulse height signal i, an intensity signal p, and a duty signal d. In a modification, calculations may be carried out without using such parameters.

In the above embodiments, the coordinates of a CIE standard chromaticity diagram are used as parameters for representing the color tone. However, those are used merely for convenience of explanation. It is not essential for the present invention. Thus, the color tone may be represented by another parameter or parameters.

In the above embodiments, the intensity of output of an LED element is used for representing the intensity of emitted light from the LED element. However, for the intensity of emitted light, any parameter corresponding to the intensity of output may be used. For example, for the intensity of emitted light, other than electric power (in a unit of W), the absolute or relative value of luminance (in a unit of $cd/m^2$), luminosity (in a unit of cd), luminous power (in a unit of lm), etc.

In the above embodiments, a case has been described wherein the color of emitted light from each LED element is white. However, the present invention is never limited to a case that the color of emitted light is white. An LED element having therein a plurality of InGaN light emitting layers, different from each other in light emission wavelength peak, sandwiched by a pair of p-type and n-type layers, can realize not only white but also a color tone far from a pure color, i.e., a soft color tone. Thus, the present invention can be applied also to an LED element that emits light in an arbitrary color including pink, a light green, a light blue, etc.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A driving method of an LED element including an active region having a multiquantum well structure, in which a plurality of light emitting layers emitting light having different light emitting wavelength peaks from each other upon current injection, are serially put on each other with a barrier layer being interposed, color of emitted light from which substantially depends only upon driving current value, and the color of emitted light changes with a change in the driving current value on a CIE chromaticity diagram, the method comprising:

a driving current value calculation step of obtaining a value for designating a current value corresponding to a desired color of emitted light from the LED element;

a driving current generation step of generating a driving current having the current value designated by the values obtained in the driving current value calculation step; and a driving current supply step of supplying the LED element with the driving current generated in the driving current generation step, said plurality of light emitting layers of the LED element being sandwiched by a pair of p-type and n-type layers, wherein a plurality of values for designating a plurality of current values corresponding to a plurality of colors of emitted light from the LED element, are obtained in the driving current value calculation step, the plurality of colors being different from each other to be mixed to make the desired color of emitting light from the LED element, and wherein a driving current including a plurality of pulses having pulse heights I different from each other, designated by the plurality of values obtained in the driving current value calculation step, is generated in the driving currrent generation step.

2. The driving method according to claim 1, wherein the method further comprises:

a duty calculation step of obtaining a plurality of duty signals d for designating duties D of the plurality of pulses, respectively, such that light in mixed colors emitted from the LED element is sensed as if the LED element emits light in the desired color at a desired intensity; and the driving current including the plurality of pulses having the pulse heights I different from each other, designated by the plurality of values obtained in the driving current value calculation step, and the duties D designated by the plurality of duty signals d obtained in the duty calculation step for the plurality of pulses, respectively, is generated in the driving current generation step.

3. The driving method according to claim 1, wherein the driving current in which the plurality of pulses appear in order is generated in the driving current generation step.

4. The driving method according to claim 1, wherein three or more values for designating three or more current values different from one another, corresponding to three or more colors of emitted light from the LED element, to be mixed to make the desired color of emitted light from the LED element, are obtained in the driving current value calculation step.

5. The driving method according to claim 1, wherein the value for designating the current value corresponding to the desired color of emitted light from the LED element is obtained in the driving current value calculation step with referring to a signal of color of emitted light from the LED element.

6. The driving method according to claim 1, wherein each of the plurality of light emitting layers is made of a nitride-base semiconductor.

7. A driving device for an LED element including an active region having a multiquantum well structure, in which a plurality of light emitting layers emitting light having different light emitting wavelength peaks from each other upon current injection are serially put on each other with a barrier layer being interposed, color of emitted light from which substantially depends only upon driving current value, and the color of emitted light changes with a change in the driving currant value along a curve on a CIE chromaticity diagram, the device comprising:

a driving current value calculator that obtains a value for designating a current value corresponding to a desired color of emitted light from the LED element; and a driving current generator that generates a driving current having the current value designated by the value obtained by the driving current value calculator, said plurality of light emitting layers of the LED element being sandwiched by a pair of p-type and n-type layers, wherein the driving current value calculator obtains a plurality of values for designing a plurality of current values corresponding to a plurality of colors of emitted light from the LED element, the plurality of colors being different from each other to be mixed to make the desired color of emitted light from the LED element, and wherein the driving current generator generates a driving current including a plurality of pulses having pulse heights I different from each other, designated by the plurality of values obtained by the driving current value calculator.

8. The driving device according to claim 7, wherein the device further comprises:

a duty calculator that obtains a plurality of duty signals d for designating duties D of the plurality of pulses, respectively, such that light in mixed colors emitted from the LED element is sensed as if the LED element emits light in the desired color at a desired intensity; and the driving current generator generates the driving current including the plurality of pulses having the pulse heights I different from other, designated by the plurality of values obtained by the driving current calculator, and the duties D designated by the plurality of duty signals d obtained by the duty calculator for the plurality of pulses, respectively.

9. The driving device according to claim 7, wherein the driving current value calculator obtains three or more values for designating three or more current values different from one another, corresponding to three or more colors of emitted light from the LED element, to be mixed to make the desired color of emitted light from the LED element.

10. An illumination apparatus comprising:

an LED element including an active region having a multiquantum well structure, in which a plurality of light emitting layers emitting light having different light emitting wavelength peaks from each other upon current injection are serially put on each other with a barrier layer being interposed, color of emitted light from which substantially depends only upon driving current value, and the color of emitted light changes with a change in the driving current value along a curve on a CIE chromaticity diagram; and a driving device for the LED element, the device comprising:

a driving current value calculator that obtains a value for designating a current value corresponding to a desired color of emitted light from the LED element; and a driving current generator that generates a driving current having the current value designated by the values obtained by the driving current value calculator, said plurality of light emitting layers of the LED element being sandwiched by a pant of p-type and n-type layers, wherein the driving current value calculator obtains a plurality of values for designating a plurality of current values corresponding to a plurality of colors of emitted light from the LED element, the plurality of colors being different from each other to be mixed to make the desired color of emitted light from the LED element, and wherein the driving current generator generates a driving current including a plurality of pulses having pulse heights I different from each other, designated by the plurality of values obtained by the driving current value calculator.

11. A display apparatus comprising:

an LED element including an active region having a multiquantum well structure, in which a plurality of light emitting layers emitting light having different light emitting wavelength peaks from each other upon current injection are serially put on each other with a barrier layer being interposed, and color of emitted light from which substantially depends only upon driving current value, and the color of emitted light changes with a change in the driving current value and the color of emitting changes with a change in the driving value along a curve on a CIE chromaticity diagram; and a driving device for the LED element, the device comprising:

a driving current value calculator that obtains a value for designating a current value corresponding to a desired color of emitted light from the LED element; and a driving current generator that generates a driving current having the current value designated by the values obtained by the driving current value, said plurality of light emitting layers of the LED element being sandwiched by a pair of p-type and n-type layers, wherein the driving current value calculator obtains a plurality of values for designating a plurality of current values corresponding to a plurality of colors of emitted light from the LED element, the plurality of colors being different from each other to be mixed to make the desired color of emitted light from the LED element, and wherein the driving current generator generates a driving current including a plurality of pulses having pulse heights I different from each other, designated by the plurality of values obtained by the driving current value calculator.

* * * * *